US011841630B2

(12) United States Patent
Kitano et al.

(10) Patent No.: US 11,841,630 B2
(45) Date of Patent: Dec. 12, 2023

(54) FIXING MEMBER AND HEAT FIXING DEVICE

(71) Applicant: CANON KABUSHIKI KAISHA, Tokyo (JP)

(72) Inventors: Yuji Kitano, Kanagawa (JP); Matsutaka Maeda, Kanagawa (JP); Makoto Souma, Kanagawa (JP); Yutaro Yoshida, Kanagawa (JP); Yasuhiro Miyahara, Tokyo (JP); Shigeo Kuroda, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/066,426

(22) Filed: Dec. 15, 2022

(65) Prior Publication Data

US 2023/0205123 A1 Jun. 29, 2023

(30) Foreign Application Priority Data

Dec. 24, 2021 (JP) ..... 2021-211426
Dec. 12, 2022 (JP) ..... 2022-197895

(51) Int. Cl.
*G03G 15/20* (2006.01)

(52) U.S. Cl.
CPC ..... *G03G 15/2057* (2013.01)

(58) Field of Classification Search
None
See application file for complete search history.

(56) References Cited

U.S. PATENT DOCUMENTS 9,086,664 B2 7/2015 Matsunaka et al.
9,268,273 B2 2/2016 Miyahara et al.
9,335,690 B2 5/2016 Asaka et al.
(Continued)

FOREIGN PATENT DOCUMENTS

JP 2007-219371 A 8/2007
JP 2014-153659 A 8/2014
(Continued)

OTHER PUBLICATIONS

Nobuyuki Otsu, "A Threshold Selection Method from Gray-Level Histograms," SMC-9(1) IEEE Trans. Syst. Man Cybern. 62-66 (Jan. 1979).
(Continued)

*Primary Examiner* — Roy Y Yi
(74) *Attorney, Agent, or Firm* — VENABLE LLP

(57) ABSTRACT

A fixing member includes a substrate having an endless shape; and an elastic layer on an outer peripheral surface of the substrate, the elastic layer containing a silicone rubber and fillers dispersed in the silicone rubber, a content of the fillers with respect to the elastic layer being 35 vol % or more and 50 vol % or less. The fillers includes at least a first filler and a second filler. The first filler is at least one selected from the group consisting of: magnesium oxide; and zinc oxide. The second filler is at least one selected from the group consisting of metal silicon and silicon carbide. A proportion of a sum of the first filler and the second filler to a total amount of the fillers in the elastic layer is 90 vol % or more. Further, the average of 6 sets of representative coefficient A is 1.4 or more.

13 Claims, 10 Drawing Sheets

(56) References Cited

U.S. PATENT DOCUMENTS

| | | | | |
|---|---|---|---|---|
| 9,367,009 | B2 | 6/2016 | Akiyama et al. | |
| 10,545,439 | B2 | 1/2020 | Matsumoto et al. | |
| 10,620,574 | B2 | 4/2020 | Kitano et al. | |
| 10,712,679 | B1 | 7/2020 | Kajiwara et al. | |
| 10,712,697 | B2 | 7/2020 | Maeda et al. | |
| 10,859,956 | B2 | 12/2020 | Maeda et al. | |
| 10,890,869 | B2 | 1/2021 | Miyahara et al. | |
| 2002/0048468 | A1* | 4/2002 | Sakaizawa | G03G 15/0241 399/175 |
| 2017/0371281 | A1* | 12/2017 | Tsubouchi | G03G 15/2053 |
| 2022/0334522 | A1 | 10/2022 | Miyahara et al. | |

FOREIGN PATENT DOCUMENTS

| | | | |
|---|---|---|---|
| JP | 2018-072519 | A | 5/2018 |
| JP | 2019-215531 | A | 12/2019 |
| WO | 2022/050249 | A1 | 3/2022 |

OTHER PUBLICATIONS

Miyahara et al., U.S. Appl. No. 18/299,241, filed Apr. 12, 2023.

* cited by examiner

FIXING MEMBER AND HEAT FIXING DEVICE

BACKGROUND

Technical Field

The present disclosure relates to a fixing member to be used in a heat fixing device of an electrophotographic image forming apparatus, such as a copying machine or a printer. The present disclosure also relates to a heat fixing device using the fixing member.

Description of the Related Art

In general, in a heat fixing device to be used for an electrophotographic image forming apparatus, such as a copying machine or a printer, a pair of heated rotating bodies, such as rollers, a film and a roller, a belt and a roller, or belts, are brought into pressure contact with each other.

A recording material holding an image formed with unfixed toner is introduced into a pressure contact portion (fixing nip) formed between the rotating bodies. Further, the unfixed toner is heated together with the recording material, and the toner is softened and melted, and is pressurized against the recording material, thereby being fixed onto the recording material as an image.

The rotating body with which the toner held on the recording material is brought into direct contact is referred to as "fixing member," and is called a fixing roller, a fixing film, a fixing belt, or the like in accordance with its shape. The rotating body to be brought into pressure contact with the fixing member through the recording material is referred to as "pressurizing member," and is called a pressurizing roller, a pressurizing film, a pressurizing belt, or the like in accordance with its shape.

The following configuration has been generally known as the fixing member An elastic layer containing a silicone rubber having heat resistance is arranged on a substrate formed from a metal, a heat-resistant resin, or the like, and a fluorine resin serving as a surface layer is further caused to cover, or formed as a thin layer on, the layer via an adhesive.

To form a uniform fixing nip, the fixing member having the above-mentioned configuration is required to have a function of instantaneously supplying, to the recording material and the toner in the fixing nip, a quantity of heat enough to soften and melt the toner.

In addition, when the elastic layer containing the silicone rubber has a low hardness, the fixing member has the following advantage. The member follows the irregularities of paper fibers serving as the recording material in the fixing nip by utilizing its excellent flexibility to suppress the occurrence of the softening and melting unevenness of the toner, and hence a high-quality image is obtained.

In recent years, an attempt has been made to improve the thermal conductivity of an elastic layer in a fixing member in its thickness direction for the purpose of, for example, increasing a print speed. In Japanese Patent Application Laid-Open No. 2019-215531, there is a disclosure of a fixing member whose elastic layer contains a rubber having dispersed therein a large-particle diameter filler having a circle-equivalent diameter of 5 μm or more, and a small-particle diameter filler having a circle-equivalent diameter of less than 5 μm. In particular, the thermal conductivity of the elastic layer in its thickness direction is improved by setting the average array degree fs and average array angle $\Phi_S$ of the small-particle diameter filler to 0.20 or more and 0.50 or less, and 600 or more and 120° or less, respectively.

However, in view of recent requests for a further increase in process speed of an electrophotographic image forming apparatus and an improvement in energy-saving property thereof, the inventors have recognized that a further improvement in thermal conductivity of the fixing belt thereof in its thickness direction is required.

SUMMARY

At least one aspect of the present disclosure is directed to providing a fixing member that is further improved in thermal conductivity in its thickness direction. In addition, at least one aspect of the present disclosure is directed to providing a heat fixing device conducive to more efficient formation of a high-quality electrophotographic image. According to at least one aspect of the present disclosure, there is provided a fixing member comprising: a substrate having an endless shape; and an elastic layer on an outer peripheral surface of the substrate, the elastic layer containing a silicone rubber and fillers dispersed in the silicone rubber, a content of the fillers with respect to the elastic layer being 35 vol % or more and 50 vol % or less, the fillers including at least a first filler and a second filler, the first filler being at least one selected from the group consisting of: magnesium oxide; and zinc oxide, the second filler being at least one selected from the group consisting of metal silicon and silicon carbide, and a proportion of a sum of the first filler and the second filler to a total amount of the fillers in the elastic layer being 90 vol % or more. When obtaining SEM images each having 115.2 μm long by 153.6 μm wide at 6 arbitrary sites of a cross-section of the elastic layer in a longitudinal direction perpendicular to a peripheral direction of the fixing member at a magnification of 2,000 times, provided that a vertical direction of each of the SEM images coincides with a thickness direction of the elastic layer, and a horizontal direction of each of the SEM images coincides with a longitudinal direction perpendicular to the thickness direction of the elastic layer, binarizing each of the SEM images so that portions of the fillers are black and a portion of the silicone rubber is white to obtain binarized images, and partitioning each of the resultant binarized images into 1,024 columns in a horizontal direction thereof and 768 rows in a vertical direction thereof with a square pixel 0.15 μm on a side, as to each of the binarized images that have been partitioned, determining a coefficient of variation of inter-surface distances between the fillers in each pixel column, i.e. 1 column×768 rows, from a standard deviation and an average of the inter-surface distances between the fillers in the pixel column to obtain 1,024 coefficients of variation, and obtaining 6 sets of a representative coefficient A of variation for each of the binarized images, where the representative coefficient A of variation is an average of 50 largest numerical values out of the resultant 1,024 coefficients of variation, an arithmetic average of 6 sets of the representative coefficient A of variation, is 1.4 or more.

According to at least one aspect of the present disclosure, there is provided a heat fixing device including: a fixing member for heating; and a pressurizing member arranged to face the fixing member, wherein the fixing member is the above-mentioned fixing member.

Further features of the present disclosure will become apparent from the following description of exemplary embodiments with reference to the attached drawings.

DESCRIPTION OF THE EMBODIMENTS

In the present disclosure, the description "XX or more and YY or less" or "from XX to YY" representing a numerical range means a numerical range including a lower limit and an upper limit that are end points unless otherwise stated. When numerical ranges are described in a stepwise manner, the upper limits and lower limits of the respective numerical ranges may be arbitrarily combined.

Figure 1:
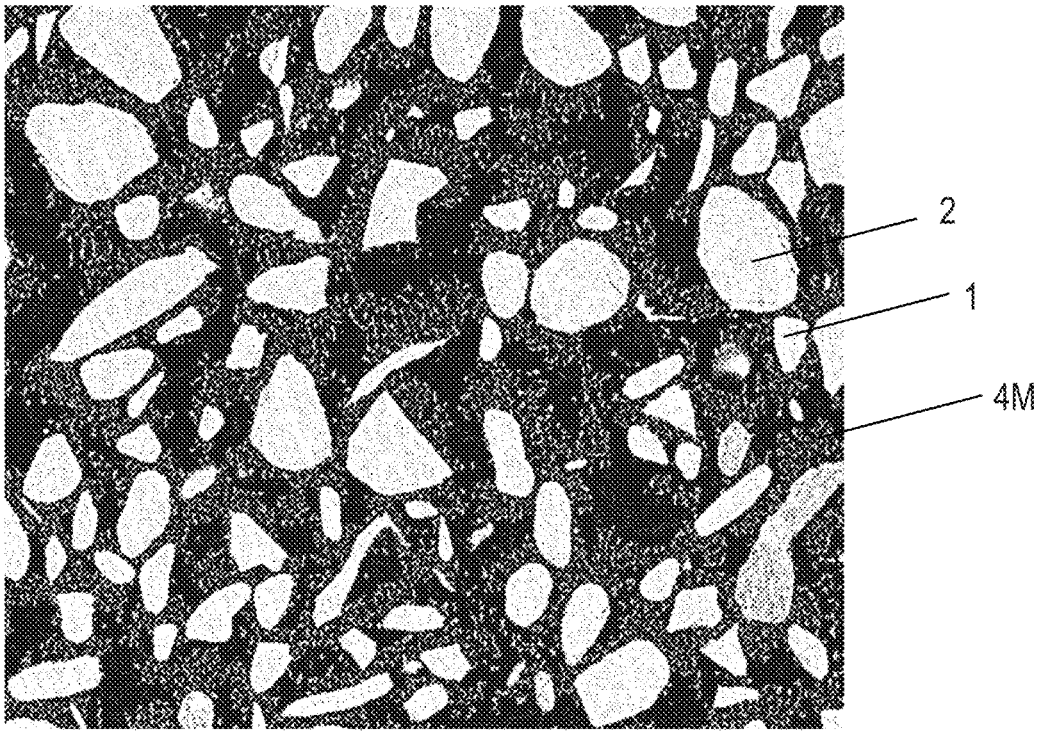
FIG. 1 is an example of a sectional SEM image of an elastic layer of the present disclosure.

In the member for electrophotography according to Japanese Patent Application Laid-Open No. 2019-215531, an electric field is applied to the elastic layer before its curing to adjust the array degree and array angle of the small-particle diameter filler. Although the same approach is also used in the present disclosure, the inventors have found that when a specific material is selected as a heat conductive filler dispersed in an elastic layer, the filler is unevenly distributed in the elastic layer, and hence a heat conductive path based on the filler can be more efficiently formed. That is, as shown in an example of an image of a section of the elastic layer observed with a scanning electron microscope (hereinafter also referred to as "SEM image") in FIG. 1, fillers of various sizes are dispersed in a silicone rubber 4M for forming the matrix of the elastic layer, and a plurality of particles of a small-particle diameter filler 1 are unevenly distributed between the particles of a large-particle diameter filler 2 in the thickness direction (vertical direction of the drawing sheet) of the layer.

An embodiment of the present disclosure is described in detail below.

A fixing member according to one aspect of the present disclosure includes: a substrate having an endless shape; and an elastic layer formed on the outer peripheral surface of the substrate.

The elastic layer contains a silicone rubber and fillers dispersed in the silicone rubber. In addition, the content of the fillers with respect to the elastic layer is 35 vol % or more and 50 vol % or less. The content of the fillers with respect to the elastic layer is preferably 40 vol % or more and 45 vol % or less.

In addition, in the fillers, the arithmetic average of 6 sets of a representative coefficient A of variation of an inter-surface distance between the fillers in the thickness direction of the elastic layer determined through the following steps (i) to (v) is 1.4 or more.

Step (i): First, SEM images (each measuring 115.2 μm long by 153.6 μm wide) are obtained at 6 arbitrary sites of a section of the elastic layer in a longitudinal direction perpendicular to the peripheral direction of the fixing member at a magnification of 2,000. The SEM images are obtained so that the vertical direction of each of the images coincides with the thickness direction of the elastic layer, and the horizontal direction thereof coincides with a direction perpendicular to the thickness direction of the elastic layer, that is, the longitudinal direction.

Step (ii): A binarized image is obtained by binarizing each of the SEM images obtained in the step (i) so that the portions of the fillers are indicated in black and the portion of the rubber is indicated in white. A method for the binarization is described later.

Step (iii): Each of the obtained binarized images is partitioned into 1,024 columns in the horizontal (longitudinal) direction and 768 rows in the vertical (thickness) direction with square pixels 0.15 μm on a side.

Step (iv): The inter-surface distances between the fillers in each pixel column (1 column×768 rows) are determined, and the coefficient of variation of the inter-surface distance between the fillers (hereinafter also simply referred to as "coefficient of variation") in each pixel column is determined from the standard deviation and average of the determined distances. Accordingly, in this step, 1,024 coefficients of variation (corresponding to the 1,024 columns) are determined.

Step (v): The average of 50 largest numerical values out of the 1,024 coefficients of variation determined in the step (iv) is defined as the representative coefficient A of variation of the inter-surface distance between the fillers in the thickness direction of the elastic layer in each of the binarized images. Then, 6 sets of the representative coefficient A of variation for each of the binarized images are determined. Next, an arithmetic average of 6 sets of the representative coefficient A of variation is determined.

The fillers include at least a first filler and a second filler. The first filler is at least one selected from the group consisting of: magnesium oxide; and zinc oxide. In addition, the second filler is at least one selected from the group consisting of: metal silicon; and silicon carbide. In addition, the proportion of the sum of the first filler and the second filler to the total amount of the fillers in the elastic layer is 90 vol % or more.

Figure 2:
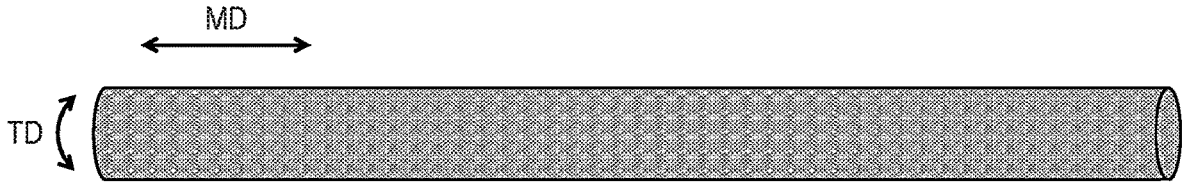
FIG. 2 is a schematic view for illustrating the peripheral direction (TD) of a fixing member according to an embodiment of the present disclosure and the direction (MD) thereof perpendicular to the TD.

In the present disclosure, as illustrated in FIG. 2, the peripheral direction of a fixing member having an endless shape is also referred to as "traverse direction" (hereinafter also referred to as "TD"), and the direction thereof perpendicular to the peripheral direction is also referred to as "machine direction" (hereinafter also referred to as "MD"). In addition, the MD is sometimes referred to as "longitudinal direction."

<Production Method>

The fixing member according to one aspect of the present disclosure may be produced by, for example, the following method.

A layer of a liquid silicone rubber mixture containing an addition-curable liquid silicone rubber, the first filler, and the second filler (hereinafter also referred to as "silicone rubber mixture layer") is formed on the substrate.

When a substrate having an endless belt shape is used, the substrate is preferably handled after a core has been inserted thereinto. After the formation of the silicone rubber mixture layer and before the curing of the silicone rubber component in the silicone rubber mixture layer, as disclosed in Japanese Patent Application Laid-Open No. 2019-215531, the outer surface of the silicone rubber mixture layer is charged. Thus, the fillers in the silicone rubber mixture layer are arrayed in the thickness direction of the silicone rubber mixture layer. After that, the silicone rubber component in the silicone rubber mixture layer is cured to form the elastic layer. The elastic layer produced by such method can have a high thermal conductivity in its thickness direction by virtue of the fillers arrayed in the thickness direction.

A method including charging the outer surface of the silicone rubber mixture layer without bringing a charging unit into contact with the outer surface is preferred as a method of charging the outer surface. Specifically, for example, a corona charger is preferably used. The corona charger can simply and inexpensively charge the outer surface in a substantially uniform manner.

Figure 3A:
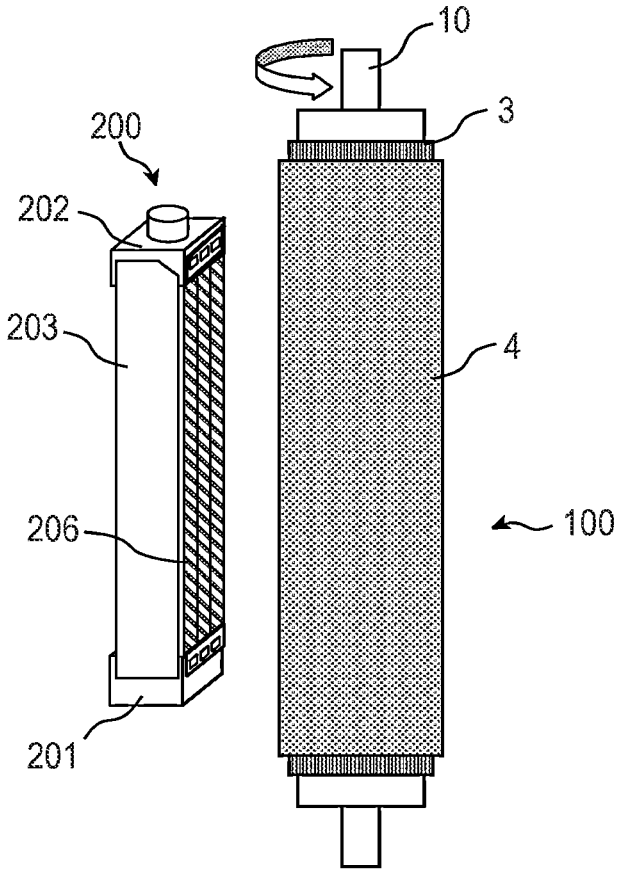
FIG. 3A and FIG. 3B are a bird's-eye view (FIG. 3A) and a sectional view (FIG. 3B) of a corona charger for forming the elastic layer of the fixing member according to the embodiment of the present disclosure.
Figure 3B:
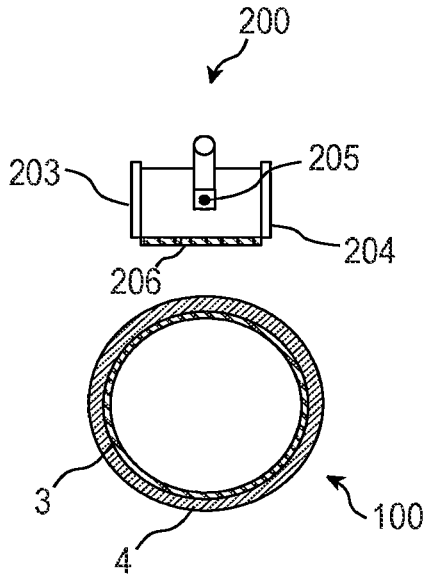

An example of a method of charging the silicone rubber mixture layer with the corona charger is illustrated in each of FIG. 3A and FIG. 3B. A substrate 3 having formed thereon a silicone rubber mixture layer 4 is mounted on the outer periphery of a core 10. In addition, a corona charger 200 is arranged so that the longitudinal direction of the corona charger 200 is substantially parallel to the MD of the silicone rubber mixture layer 4. Next, while the substrate 3 having formed thereon the silicone rubber mixture layer 4 is rotated, the corona charger 200 is operated to charge the outer surface of the silicone rubber mixture layer. The charging of the surface of the silicone rubber mixture layer 4 can unevenly distribute the fillers in the silicone rubber mixture layer in its thickness direction. After that, the curing of the silicone rubber mixture layer 4 can produce the elastic layer 4 according to one aspect of the present disclosure.

The inventors have assumed the mechanism via which the charging of the outer surface of the silicone rubber mixture layer unevenly distributes the fillers in the silicone rubber mixture layer to be as described below.

Magnesium oxide and zinc oxide each serving as the first filler have high thermal conductivities and high electrical resistance values, and hence may each be charged to positive charge by shearing at the time of the formation of the silicone rubber mixture layer by the application of the silicone rubber mixture onto the outer peripheral surface of the substrate. Meanwhile, metal silicon and silicon carbide each serving as the second filler have high thermal conductivities, but their electrical resistance values are not very high. Accordingly, the second filler may be hardly charged even when a shear force is applied to the silicone rubber mixture at the time of the application of the silicone rubber mixture to the outer peripheral surface of the substrate. That is, the first filler charged to positive charge and the second filler that is substantially free from being charged may be present in the silicone rubber mixture layer. When charge is imparted to the outer surface of the silicone rubber mixture layer in such state, the first filler and the second filler are brought close to each other by the actions of: an electrostatic field generated between the first filler and the second filler; and an electric field generated by the charging of the outer surface of the silicone rubber mixture layer. Probably as a result of the foregoing, the fillers are unevenly distributed in the silicone rubber mixture layer.

The proportion of the sum of the first filler and the second filler to the total amount of the fillers is preferably 90 vol % or more. In this case, the uneven distribution of the fillers in the silicone rubber mixture layer in its thickness direction can be more efficiently achieved. As a result, an elastic layer that is more improved in thermal conductivity in its thickness direction can be more efficiently produced.

<Method of Evaluating Extent to which Fillers in Elastic Layer are Unevenly Distributed>

As described above, a parameter calculated by using a binarized image, which is obtained from a SEM image of a section of the elastic layer, and in which the fillers and the rubber portion except the fillers can be distinguished from each other, is used in the evaluation of the extent to which the fillers in the elastic layer are unevenly distributed. In the calculation of the parameter, the first filler and the second filler are not distinguished from each other.

Figure 4:
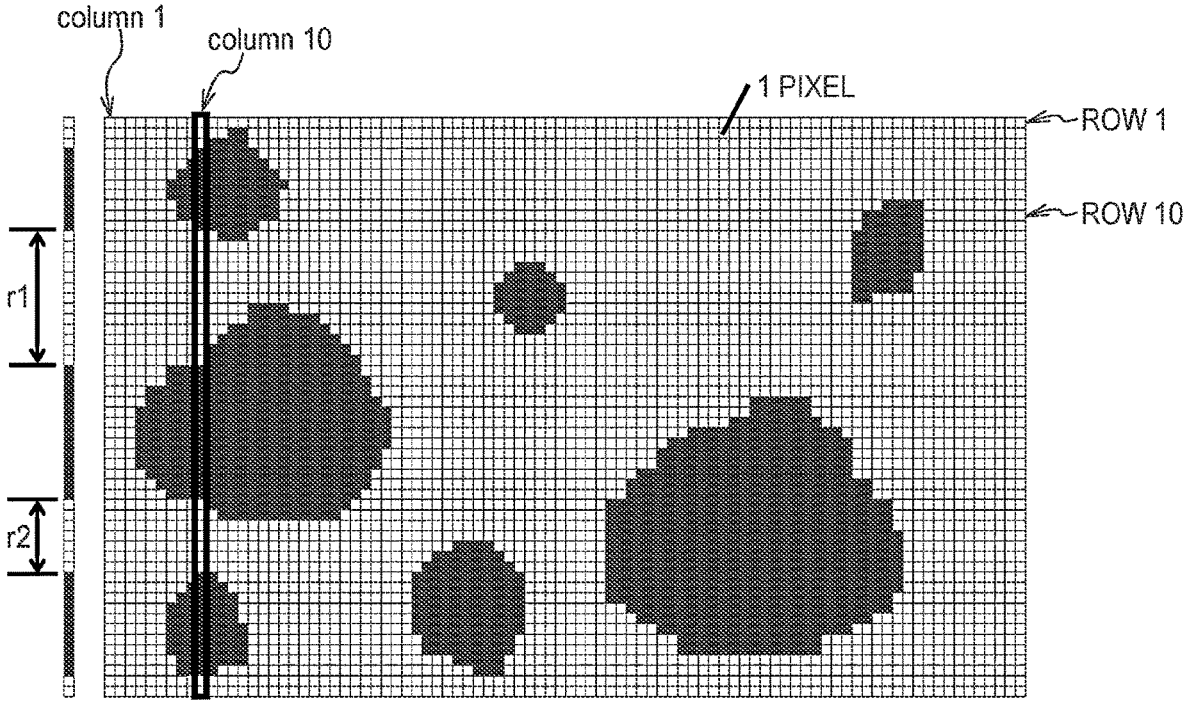
FIG. 4 is a schematic view for illustrating an inter-surface distance between fillers to be calculated from a binarized image of a section of the elastic layer of the present disclosure.

Specifically, the evaluation may be performed by: calculating the standard deviation and average of the inter-surface distances between the fillers for the thickness direction of the elastic layer or the longitudinal direction thereof perpendicular to the peripheral direction of the fixing member; and dividing the standard deviation by the average to determine a coefficient of variation. In FIG. 4, a white portion represents the rubber except the fillers, and a black portion represents a filler portion. In addition, reference symbols r1 and r2 in FIG. 4 each represent an example of the inter-surface distance between the fillers in a part of a pixel column whose column number is 10. That is, in the present disclosure, as the fillers are not unevenly distributed but more uniformly dispersed in each column, the standard deviation of the inter-surface distances between the fillers in one pixel column becomes smaller. In addition, as the fillers are unevenly distributed to a larger extent in each column, the standard deviation of the inter-surface distances between the fillers becomes larger. For example, when the volume proportion of the fillers in the elastic layer is reduced, the absolute value of the standard deviation becomes larger, and hence the values of the standard deviations cannot be unconditionally compared to each other.

In view of the foregoing, in the present disclosure, the evaluation is performed with the coefficient of variation obtained by dividing the standard deviation of the inter-surface distances between the fillers by the average thereof so that even when the volume proportion of the fillers in a column is different from that in another column, the extents to which the fillers are unevenly distributed in the columns can be compared to each other. Detailed description is given below.

First, an evaluation sample is produced. For example, 6 samples each measuring 5 mm long by 5 mm wide, and each having a thickness equal to the total thickness of the elastic layer of the fixing member are collected from arbitrary sites of the elastic layer. A section of each of the resultant 6 samples in a longitudinal direction perpendicular to the peripheral direction of the fixing member, that is, a section thereof in the thickness-MD directions of the elastic layer is subjected to polishing processing with an ion beam. For example, a cross section polisher may be used in the polishing processing of the section with an ion beam. The polishing processing of the section with an ion beam can prevent the falling of the fillers from the sample and the inclusion of a polishing agent, and can form a section having a small number of polishing marks.

Figure 5A:
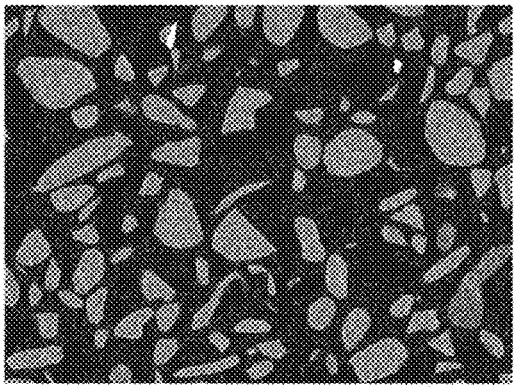
FIG. 5A is a SEM image of the section of the elastic layer.

Subsequently, the section of the elastic layer is observed with a scanning electron microscope (SEM). Thus, a SEM image of the section is obtained (FIG. 5A). The observation is performed in a backscattered electron image mode under the condition of a magnification of 2,000, and a backscattered electron image is obtained under the conditions of an acceleration voltage of 8.0 kV and a working distance of 4 mm. The SEM is not particularly limited as long as the SEM image can be obtained with the SEM under the above-mentioned conditions. An example thereof may be "FE-SEM SIGMA500 VP" (product name, manufactured by Carl Zeiss AG).

Figure 5B:
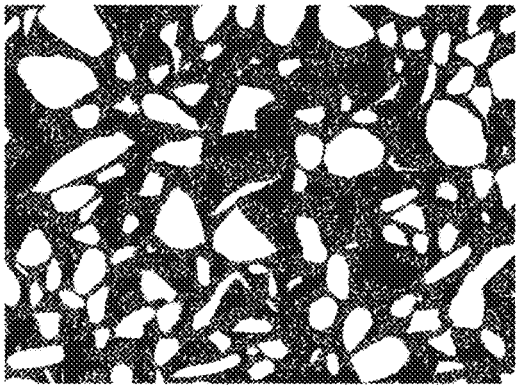
FIG. 5B is an image obtained by subjecting the image of FIG. 5A to monochromatic binarization processing.

Next, the resultant SEM image is subjected to binarization processing with image processing software so that its filler portion is white and its silicone rubber portion except the fillers is black. Thus, a binarized image is obtained (FIG. 5B). For example, Otsu's method described in "IEEE Transactions on SYSTEMS, MAN, AND CYBERNETICS, vol. SMC-9, No. 1, January 1979, PP. 62-66" may be used as an approach for the binarization. The binarized image is a gray-scale image including only brightness information. In the present disclosure, all the binarized images obtained by subjecting the SEM images to image processing are gray-scale images having the same format unless stated.

An approach to deriving the coefficient of variation of the inter-surface distance between the fillers from the 6 binarized images thus obtained is described.

All the binarized images are each a digital image format in which pixels are arranged in a lattice manner because the binarized images are obtained by applying a digital image processing technology to the SEM images. In addition, it is determined from the magnification and the image size at the time of the obtainment of the SEM images that one pixel of each of the binarized images is a square 0.15 μm on a side. In view of the foregoing, to determine the inter-surface distance between the fillers from each of the binarized images, the binarized image is partitioned into 1,024 columns in the longitudinal direction of the binarized image (corresponding to the longitudinal direction of the elastic layer) and 768 rows in the vertical direction of the binarized image (corresponding to the thickness direction of the elastic layer) with the square pixels 0.15 μm on a side.

Next, the inter-surface distance between the fillers is calculated for each pixel column (1 column×768 rows) of each of the binarized images that have been partitioned. Specifically, for example, when, out of the 768 pixels, the filler portion, that is, a black pixel is represented by "1", and the silicone rubber portion, that is, a white pixel is represented by "0", a part of a certain pixel column may be represented as described below.

In the pixel column represented as described above, the inter-surface distances between the fillers are 2 pixels, 4 pixels, 5 pixels, and 3 pixels from the left. The inter-surface distance between the fillers corresponds to the number of the continuous "0" pixels, and hence the inter-surface distance between the fillers in a pixel column may be calculated by counting the number of continuous "0" pixels in the pixel column. The number of continuous "0" pixels only needs to be multiplied by 0.15 μm for converting the inter-surface distance between the fillers into an actual distance.

Figure 6A:
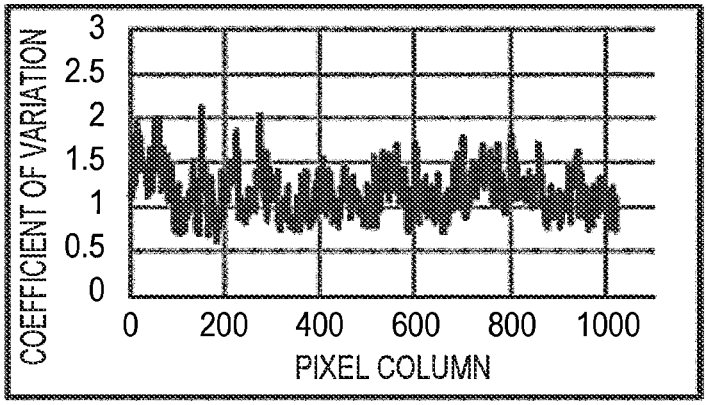
FIG. 6A is a graph for showing a relationship between a pixel column and the coefficient of variation of the inter-surface distance between the fillers.

In addition, the standard deviation and average of the inter-surface distances between the fillers in each pixel column (1 column×768 rows) of the elastic layer (hereinafter referred to as "inter-surface distances D1") are used to determine 1,024 coefficients of variation of the inter-surface distance between the fillers for each of the 6 binarized images. FIG. 6A is a graph obtained by plotting the coefficients of variation of the respective pixel columns obtained from a binarized image serving as an example. In FIG. 6A, the axis of abscissa indicates a pixel column number, and the axis of ordinate indicates the coefficient of variation of the inter-surface distance D1 between the fillers. The axis of abscissa indicates pixel columns No. 1 to No. 1,024 from the left to the right. In addition, the average of 50 values corresponding to about the top 5% of the numerical values of the coefficients of variation is defined as the representative coefficient A of variation of the inter-surface distance D1 in each binarized image.

Figure 6B:
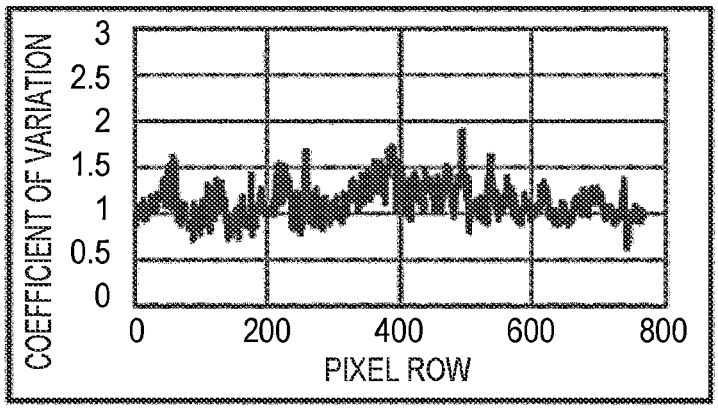
FIG. 6B is a graph for showing a relationship between a pixel row and the coefficient of variation.

Further, the inter-surface distances between the fillers in each pixel row (1 row×1,024 columns) in the longitudinal direction of the elastic layer (the horizontal direction of FIG. 1) (hereinafter referred to as "inter-surface distances D2") are determined for each of the 6 binarized images as in the inter-surface distances D1. Then, 768 coefficients of variation of the inter-surface distance D2 between the fillers are determined from the standard deviation and average of the inter-surface distances D2. FIG. 6B is a graph obtained by plotting the coefficients of variation of the respective pixel rows obtained from a binarized image serving as an example. In FIG. 6B, the axis of abscissa indicates a pixel row number, and the axis of ordinate indicates the coefficient of variation of the inter-surface distance D2 between the fillers. The axis of abscissa indicates pixel rows No. 1 to No. 768 from the left to the right. In addition, the average of 40 values corresponding to about the top 5% of the numerical values of the coefficients of variation is defined as the representative coefficient B of variation of the inter-surface distance D2 of the fixing member in each binarized image.

In the fixing member according to one aspect of the present disclosure, the average of 6 sets of the representative coefficient A of variation of the inter-surface distance D1 is 1.4 or more. In the elastic layer of such fixing member, the fillers are unevenly distributed in the thickness direction of the elastic layer, and hence heat conductive paths based on the fillers are more effectively formed. As a result, the elastic layer can have a higher thermal conductivity in its thickness direction. Accordingly, the fixing member can more efficiently supply heat to a recording material and unfixed toner on the recording material in a fixing nip.

In addition, in the fixing member according to one aspect of the present disclosure, the average of 6 sets of the representative coefficient B of variation of the inter-surface distance D2 is preferably 1.4 or more. In the elastic layer of the fixing member in which the average of 6 sets of the representative coefficient B of variation of the inter-surface distance D2 is 1.4 or more, the fillers are also unevenly distributed in its longitudinal direction, and hence the heat conductive paths are also more effectively formed in the longitudinal direction. Accordingly, the elastic layer can have a larger number of heat conductive paths leading to its thickness direction. As a result, the fixing member can even more efficiently supply heat to the recording material and the unfixed toner on the recording material in the fixing nip.

<Method of Evaluating Circle-Equivalent Diameters and Area Proportions of Fillers in Elastic Layer>

In the SEM backscattered electron image of the section of the elastic layer described above, the rubber, the first filler, and the second filler have different brightnesses in accordance with their respective constituent elements. The backscattered electron image is ternarized by utilizing the difference in brightness. Specifically, a ternarized image may be obtained by classifying the brightness of the backscattered electron image into 256 gray levels.

Figure 5C:
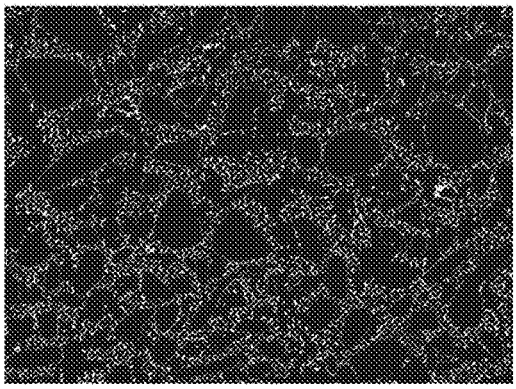
FIG. 5C is an image in which only a first filler is sampled from an image of a section of the fixing member based on a SEM backscattered electron image.
Figure 5D:
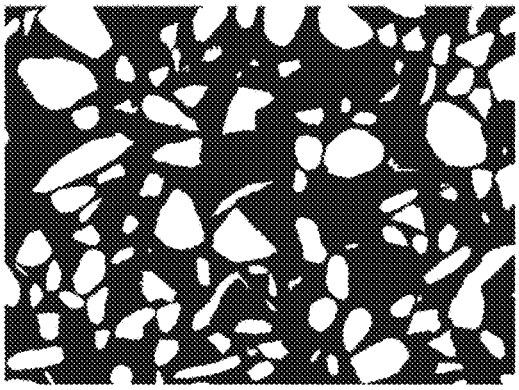
FIG. 5D is an image in which only a second filler is sampled from the image of the section of the fixing member based on the SEM backscattered electron image.

A first image (FIG. 5C) in which only the first filler was sampled from the SEM image of the section of the fixing member, and a second image (FIG. 5D) in which only the second filler was sampled therefrom were obtained by utilizing the above-mentioned difference in brightness in the backscattered electron image. Specifically, first, the brightness distribution of the SEM image is determined with image analysis software (product name: Image-Pro Plus, manufactured by Media Cybernetics, Inc.). Next, a ternarized image in which the rubber, the first filler, and the second filler can be distinguished from each other is obtained by setting the brightness range of the determined brightness distribution. The first image in which only the first filler is sampled, and the second image in which only the second filler is sampled are obtained from the resultant ternarized image.

An approach to distinguishing the rubber, the first filler, and the second filler from each other is not limited to an approach including using the difference in brightness in the SEM image. The rubber, the first filler, and the second filler may also be distinguished from each other with high accuracy by, for example, obtaining an element mapping image having the same field of view as that of the SEM image by scanning electron microscope energy dispersive X-ray spectrometry (SEM-EDS), and then checking the image with the SEM image to identify the respective particles in the image.

In each of the images obtained by the above-mentioned procedure, one filler particle is formed so as to spread over a plurality of pixels. To identify which range corresponds to one particle, the particles are subjected to labeling processing. The labeling is processing in which masses in which high-brightness portions are connected to each other in a binarized image are each given a number. A method of judging the connection generally comes in the following two kinds of methods: a 4-connection method in which only the vertical and horizontal directions of a pixel are effective; and an 8-connection method in which connections in oblique directions are also effective. In the present disclosure, after the connection has been judged by the 8-connection method, the first image is subjected to the labeling processing so that its filler particles are each given a number (label).

Next, the circle-equivalent diameter of each filler and the area proportion of each filler (the proportion of the gross area of each filler to the total area of the corresponding image) are calculated from each of the first image in which only the first filler is sampled, and the second image in which only the second filler is sampled. The circle-equivalent diameter of each filler refers to the diameter of a circle having the same area as the area of the filler. Specifically, the number of pixels for forming each labeled filler particle is calculated, and an actual filler area is calculated by multiplying the number of pixels by the area of one pixel (0.15 μm×0.15 μm). Further, the circle-equivalent diameter is calculated by determining the diameter of a circle having the filler area. In addition, the area proportion is calculated by dividing the sum of the filler areas of all the filler particles in the image by the area of the entirety of the image.

The distribution of the circle-equivalent diameters of each of the fillers is determined as a relative distribution on a volume basis from the total sum of numerical values at the 6 sites in the thickness-MD directions of the elastic layer. In addition, the area proportion of each of the fillers is calculated as the average of numerical values at the 6 sites in the thickness-MD directions of the elastic layer. The area proportion of each of the fillers is identical in meaning to the volume blending proportion of the filler. Accordingly, the volume blending proportion (area proportion) may be adjusted by the formulation of the layer.

The content of the fillers with respect to the elastic layer is preferably 35 vol % or more and 50 vol % or less. When the content of the fillers with respect to the elastic layer is set within the range, the elasticity of the elastic layer can be sufficiently maintained. The elastic layer according to one aspect of the present disclosure can exhibit a sufficiently improved thermal conductivity in the thickness direction thereof, even when the content of the fillers with respect to the elastic layer is 50 vol % or less.

The circle-equivalent diameter of each of the fillers is preferably 0.1 μm or more and 100 μm or less, more preferably 0.1 μm or more and 50 μm or less. When the circle-equivalent diameter is set within the range, it becomes easier to set the content of the fillers in the elastic layer within the above-mentioned range (from 35 vol % to 50 vol %). In addition, an influence on the surface property of the elastic layer accompanying the incorporation of the fillers into the elastic layer can be made smaller.

In addition, it is more preferred that the circle-equivalent diameter of the first filler be 5 μm or less, and the circle-equivalent diameter of the second filler be 5 μm or more. Magnesium oxide and zinc oxide each serving as the first filler may each be easily charged to positive charge by shearing occurring at the time of the application of the rubber material, and hence the filler may be more easily moved by an electrostatic field or an electric field as its circle-equivalent diameter becomes smaller. In contrast, metal silicon and silicon carbide each serving as the second filler are hardly charged by the shearing occurring at the time of the application of the rubber material, and hence the filler may be hardly moved by an electrostatic field or an electric field. Accordingly, as the circle-equivalent diameter of the second filler becomes larger, it may become easier to unevenly distribute a larger amount of the first filler around the second filler.

In addition, the ratio (volume proportion of second filler/volume proportion of first filler) of the volume proportion of the second filler in the elastic layer to the volume proportion of the first filler in the elastic layer is more preferably 2.0 or more and 7.0 or less. When the blending proportions of the fillers are set as described above, the average of the representative coefficients A and B of variation of the inter-surface distance between the fillers can be effectively increased. In other words, such ratio is more preferred because the uneven distribution of the fillers enables efficient formation of heat conductive paths.

Although the shapes of the fillers are not particularly limited, the repose angle of the second filler is preferably 35° or more and 52° or less. When the shape of each of the fillers is a shape free of a corner that is a pointed portion, that is, a round shape, there is a tendency in that the filler hardly piles up as an accumulation in a mountain manner, and hence its repose angle reduces. The shape of the second filler is more preferably a shape free of a corner that is a pointed portion because the first filler is unevenly distributed around the second filler in an easier manner.

The inventors have assumed the reason why when the shape of the second filler is free of a corner that is a pointed portion, it becomes easier to unevenly distribute the first filler around the second filler to be as described below.

As described above, magnesium oxide or zinc oxide to be used as the first filler may be easily charged to positive charge by the shearing occurring at the time of the application of the rubber material. Meanwhile, metal silicon or silicon carbide to be used as the second filler is hardly charged even by the shearing occurring at the time of the application of the rubber material. At this time, when the second filler has a corner, an electrostatic field between the first filler and the second filler is locally formed in the corner portion of the second filler, and hence the range of the electrostatic field narrows. Meanwhile, when the second filler is free of a corner, the electrostatic field is more uniformly formed around the second filler, and hence the range of the electrostatic field widens. The foregoing is a possible reason.

A mechanical or physical method is available as a method of obtaining the second filler having a repose angle within the above-mentioned range. For example, HYBRIDIZATION SYSTEM (manufactured by Nara Machinery Co., Ltd.) includes a rotor that rotates at a high speed, a stator, and a circulation circuit. When the filler is treated with the HYBRIDIZATION SYSTEM, the filler repeatedly receives mechanical actions including an impact force serving as a main constituent, compression, friction, and a shear force while being dispersed in the machine. Thus, the corners of the filler are removed or rounded. In addition, when the filler is treated with a sphering apparatus (e.g., "FACULTY" (trademark, manufactured by Hosokawa Micron Corporation)), the corners of the filler are removed, or the corners are rounded, by the high-speed rotation of its hammer.

A fixing member and a heat fixing device according to embodiments of the present disclosure are described in detail below based on specific configurations.

(1) Outline of Configuration of Fixing Member

Details about the fixing member according to this embodiment are described with reference to the drawings.

Figure 7A:
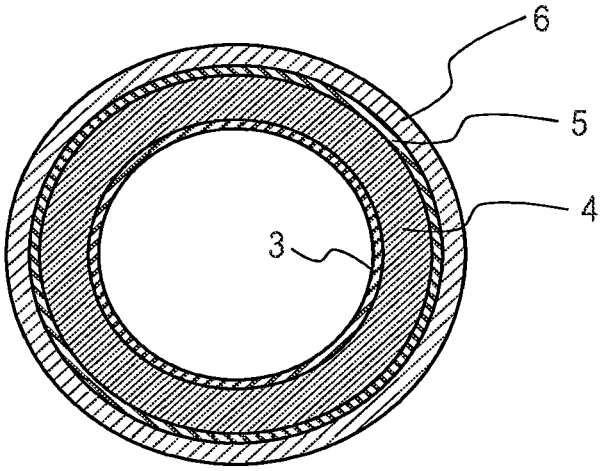
FIG. 7A and FIG. 7B are outline sectional schematic views of the fixing member according to the embodiment of the present disclosure in a belt shape and a roller shape, respectively.
Figure 7B:
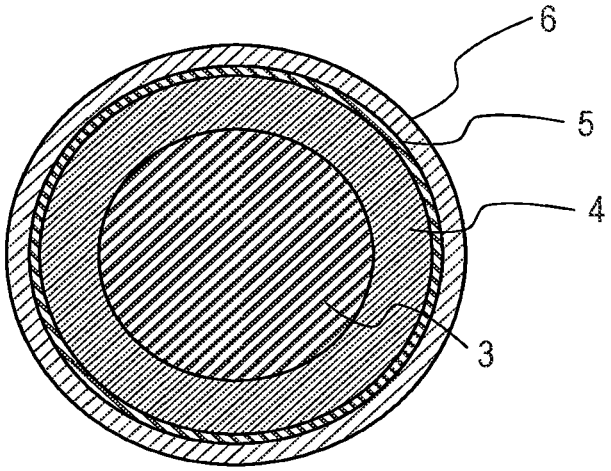

FIG. 7A and FIG. 7B are each a sectional schematic view for illustrating the fixing member according to one aspect of the present disclosure. FIG. 7A is an illustration of an example of a belt-shaped fixing member, and FIG. 7B is an illustration of an example of a roller-shaped fixing member. In each of FIG. 7A and FIG. 7B, a substrate is represented by reference numeral 3, and a silicone rubber-containing elastic layer covering the outer peripheral surface of the substrate 3 is represented by reference numeral 4. As described above, the fixing member according to this embodiment includes the substrate and the silicone rubber-containing elastic layer formed on the substrate. As illustrated in each of FIG. 7A and FIG. 7B, the fixing member may include a surface layer 6 on the outer periphery of the silicone rubber-containing elastic layer 4. In addition, the member may include an adhesion layer 5 between the silicone rubber-containing elastic layer 4 and the surface layer 6, and in this case, the surface layer 6 is fixed to the outer peripheral surface of the silicone rubber-containing elastic layer 4 by the adhesion layer 5.

(2) Substrate of Fixing Member

A material for the substrate is not particularly limited, and a known material in the field of the fixing member may be appropriately used. Examples of the material for forming the substrate include: metals, such as aluminum, iron, nickel, and copper; alloys such as stainless steel; and resins such as polyimide.

Herein, when the heat fixing device is a heat fixing device in which the substrate is heated by using an induction heating system as a method of heating the fixing member, the substrate includes at least one kind of metal selected from the group consisting of: nickel; copper; iron; and aluminum. Of those, particularly when the heat fixing device is of an electromagnetic induction heating system, a substrate material heatable by induction heating is selected, and an alloy using nickel or iron as a main component is suitably used from the viewpoint of heat generation efficiency. The term "main component" as used herein means a component that is incorporated in the largest amount out of the components forming an object (the substrate in this case).

The shape of the substrate may be appropriately selected in accordance with the shape of the fixing member, and the substrate may be formed into various shapes, such as an endless belt shape, a hollow cylindrical shape, a solid columnar shape, and a film shape. Although a solid mandrel is used as the substrate 3 in FIG. 7B, a hollow mandrel may be used as the substrate 3, and the hollow mandrel may include a heat source such as a halogen lamp therein.

In the case of the fixing belt, the thickness of the substrate is preferably set to, for example, a range of from 15 μm or more to 80 μm or less. When the thickness of the substrate is set within the range, both the strength and flexibility of the belt may be achieved at high levels. In addition, on the surface of the substrate on a side opposite to a side facing the elastic layer, for example, a layer for preventing the wear of the inner peripheral surface of the fixing belt in the case where the inner peripheral surface of the fixing belt is in contact with any other member, or a layer for improving slidability with the other member may be arranged.

The surface of the substrate on the side facing the elastic layer may be subjected to surface treatment for imparting a function such as an adhesive property with the elastic layer. Examples of the surface treatment include: physical treatments, such as blasting treatment, lapping treatment, and polishing; and chemical treatments, such as oxidation treatment, coupling agent treatment, and primer treatment. In addition, the physical treatments and the chemical treatments may be used in combination.

Particularly when the elastic layer is used, the outer surface of the substrate is preferably treated with a primer for improving adhesiveness between the substrate and the elastic layer. For example, a primer in a paint state obtained by appropriately blending and dispersing an additive in an organic solvent may be used as the primer. Such primer is commercially available. Examples of the additive may include silane coupling agents, silicone polymers, hydrogenated methylsiloxane, alkoxysilanes, catalysts for accelerating a reaction, such as hydrolysis, condensation, or addition, and colorants such as iron oxide. The primer treatment is performed by: applying the primer to the outer surface of the substrate; and subjecting the resultant to drying and calcining processes.

The primer may be appropriately selected depending on, for example, the material for the substrate, the kind of the elastic layer, and a reaction form at the time of crosslinking. For example, when the material for forming the elastic layer contains a large amount of an unsaturated aliphatic group, a material containing a hydrosilyl group is preferably used as the primer for imparting the adhesive property by a reaction with the unsaturated aliphatic group. In addition, when the material for forming the elastic layer contains a large amount of a hydrosilyl group, in contrast, a material containing an unsaturated aliphatic group is preferably used as the primer. Any other material except the foregoing such as a material containing an alkoxy group may be appropriately selected as the primer depending on the kinds of the substrate and the elastic layer serving as adherends.

(3) Elastic Layer

The elastic layer is a layer for imparting flexibility to the fixing member for securing a fixing nip in the heat fixing device. When the fixing member is used as a heating member to be brought into contact with toner on a recording material such as paper, the elastic layer also functions as a layer for imparting such flexibility that the surface of the fixing member may follow the irregularities of the recording material such as paper. To sufficiently express those functions even in an environment where the temperature of a non-paper passing region becomes a temperature as high as about 240° C., a silicone rubber excellent in heat resistance is incorporated into the elastic layer.

In addition, to obtain an elastic layer in which the arithmetic average of 6 sets of the representative coefficient A of variation of the inter-surface distance D1 between the fillers is 1.4 or more as described above, a silicone rubber having a high insulating property is suitably used as a rubber material serving as a binder in the elastic layer.

The silicone rubber-containing elastic layer may be formed by curing a layer of an addition-curable liquid silicone rubber mixture (hereinafter sometimes simply described as "liquid silicone rubber mixture") containing at least the fillers and, for example, an addition-curable liquid silicone rubber. The addition-curable liquid silicone rubber contains the following components (a), (b), and (c) serving as essential components, and may further contain a component (d) that is an optional component:

(a) an organopolysiloxane having an unsaturated aliphatic group;

(b) an organopolysiloxane having active hydrogen bonded to silicon (crosslinking agent);

(c) a catalyst (e.g., a platinum compound); and (d) a curing retarder.

The component (a) functions as a crosslinking point at the time of the curing reaction. The component (b) is a crosslinking agent. The component (c) is a catalyst for accelerating the curing reaction. The component (d) is a curing retarder (inhibitor) for controlling a reaction starting time. The components (a) to (d) are described below.

(a) Organopolysiloxane Having Unsaturated Aliphatic Group

The organopolysiloxane having an unsaturated aliphatic group (hereinafter sometimes referred to as "component (a)") is an organopolysiloxane having an unsaturated aliphatic group such as a vinyl group, and examples thereof include organopolysiloxanes represented by the following structural formula 1 and structural formula 2.

Structural formula 1

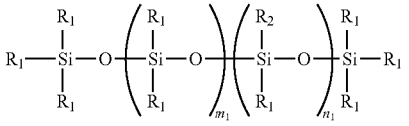

In the structural formula 1, $m_1$ represents an integer of 0 or more, and $n_1$ represents an integer of 3 or more. In addition, in the structural formula 1, $R_1$s each independently represent a monovalent unsubstituted or substituted hydrocarbon group free of any unsaturated aliphatic group, provided that at least one of $R_1$s represents a methyl group, and $R_2$s each independently represent an unsaturated aliphatic group.

Structural formula 2

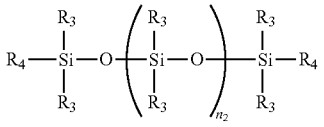

In the structural formula 2, $n_2$ represents a positive integer, $R_3$s each independently represent a monovalent unsubstituted or substituted hydrocarbon group free of any unsaturated aliphatic group, provided that at least one of $R_3$s represents a methyl group, and $R_4$s each independently represent an unsaturated aliphatic group.

In the structural formula 1 and the structural formula 2, examples of the monovalent unsubstituted or substituted hydrocarbon group free of any unsaturated aliphatic group that may be represented by any one of $R_1$s and $R_3$s may include the following groups.

Unsubstituted Hydrocarbon Groups

Alkyl groups (e.g., a methyl group, an ethyl group, a propyl group, a butyl group, a pentyl group, and a hexyl group). Aryl groups (e.g., a phenyl group).

Substituted Hydrocarbon Groups

Alkyl groups (e.g., substituted alkyl groups, such as a chloromethyl group, a 3-chloropropyl group, a 3,3,3-trifluoropropyl group, a 3-cyanopropyl group, and a 3-methoxypropyl group).

The organopolysiloxanes represented by the structural formula 1 and the structural formula 2 each have at least one methyl group directly bonded to a silicon atom forming a chain structure. However, 50% or more of each of $R_1$s and $R_3$s preferably represent methyl groups because such organopolysiloxane is easily synthesized and handled, and all of $R_1$s and $R_3$s more preferably represent methyl groups.

In addition, in the structural formula 1 and the structural formula 2, examples of the unsaturated aliphatic group that may be represented by any one of $R_2$s and $R_4$s may include the following groups. That is, examples of the unsaturated aliphatic group may include a vinyl group, an allyl group, a 3-butenyl group, a 4-pentenyl group, and a 5-hexenyl group. $R_2$s and $R_4$s each preferably represent a vinyl group out of those groups because such organopolysiloxane is easily synthesized and handled, and is available at low cost, and its crosslinking reaction is easily performed.

The viscosity of the component (a) is preferably 100 $mm^2/s$ or more and 50,000 $mm^2/s$ or less from the viewpoint of its moldability. The viscosity (kinematic viscosity) may be measured based on JIS Z 8803:2011 with a capillary viscometer, a rotational viscometer, or the like.

In addition, the components (a) may be used alone or in combination thereof.

(b) Organopolysiloxane Having Active Hydrogen Bonded to Silicon (Crosslinking Agent)

The organopolysiloxane having active hydrogen bonded to silicon (hereinafter sometimes referred to as "component (b)") functions as a crosslinking agent that reacts with an unsaturated aliphatic group of the component (a) by virtue of the action of the catalyst to form the cured silicone rubber.

Any organopolysiloxane may be used as the component (b) as long as the organopolysiloxane has a Si—H bond. An organopolysiloxane having an average of 3 or more hydrogen atoms bonded to a silicon atom in a molecule thereof is particularly suitably used from the viewpoint of its reactivity with an unsaturated aliphatic group of the component (a). Specific examples of the component (b) may include a linear organopolysiloxane represented by the following structural formula 3 and a cyclic organopolysiloxane represented by the following structural formula 4.

Structural formula 3

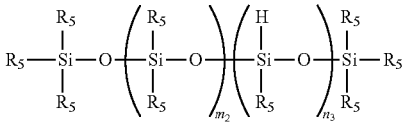

In the structural formula 3, $m_2$ represents an integer of 0 or more, $n_3$ represents an integer of 3 or more, and $R_5$s each independently represent a monovalent unsubstituted or substituted hydrocarbon group free of any unsaturated aliphatic group.

Structural formula 4

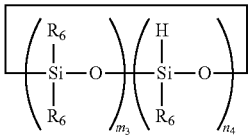

In the structural formula 4, $m_3$ represents an integer of 0 or more, $n_4$ represents an integer of 3 or more, and $R_6$s each independently represent a monovalent unsubstituted or substituted hydrocarbon group free of any unsaturated aliphatic group.

Examples of the monovalent unsubstituted or substituted hydrocarbon group free of any unsaturated aliphatic group that may be represented by any one of $R_5$s and $R_6$s in the structural formula 3 and the structural formula 4 may include the same groups as those represented by $R_1$s in the structural formula 1 described above. Fifty percent or more of each of $R_5$s and $R_6$s preferably represent methyl groups out of those groups because such organopolysiloxane is easily synthesized and handled, and excellent heat resistance is easily obtained, and all of $R_5$s and $R_6$s more preferably represent methyl groups.

The components (b) may be used alone or in combination thereof.

(c) Catalyst

The catalyst to be used in the formation of the silicone rubber may be, for example, a hydrosilylation catalyst for accelerating a curing reaction. A known substance, such as a platinum compound or a rhodium compound, may be used as the hydrosilylation catalyst. The blending amount of the catalyst may be appropriately set and is not particularly limited. The catalyst is hereinafter sometimes referred to as "component (c)".

(d) Curing Retarder

An agent called a curing retarder may be blended in order to adjust the curing reaction rate of hydrosilylation (addition curing). Specific examples thereof may include 2-methyl-3-butyn-2-ol and 1-ethynyl-1-cyclohexanol. The curing retarder is hereinafter sometimes referred to as "component (d)".

The presence of a cured silicone rubber derived from a silicone polymer containing a methyl group bonded to a silicon atom in the silicone rubber-containing elastic layer may be recognized by infrared spectroscopy. Attenuated total reflection (ATR) measurement with an apparatus (FT-IR) (e.g., product name: Frontier FT IR, manufactured by PerkinElmer) may be performed. A silicon-oxygen bond (Si—O) serving as the main chain structure of silicone shows strong infrared absorption around a wavenumber of 1,020 $cm^{-1}$ in association with stretching vibration. Further, a methyl group bonded to a silicon atom (Si—$CH_3$) shows strong infrared absorption around a wavenumber of 1,260 $cm^{-1}$ in association with bending vibration resulting from its structure. Accordingly, their presence may be recognized.

The content of the silicone rubber in the silicone rubber-containing elastic layer may be determined with a thermogravimetric apparatus (TGA) (e.g., product name: TGA851, manufactured by Mettler-Toledo). The elastic layer is cut out with a razor or the like, and about 20 mg thereof is precisely weighed and loaded into an alumina pan to be used in the apparatus. The alumina pan containing the sample is set in the apparatus, and under a nitrogen atmosphere, the sample is heated from room temperature to 800° C. at a rate of temperature increase of 20° C. per minute. Further, the temperature is kept constant at 800° C. for 1 hour. In the nitrogen atmosphere, along with the temperature increase, the cured silicone rubber component is decomposed and removed by cracking without being oxidized, and hence the weight of the sample reduces. Comparison between the weights before and after such measurement can determine the content of the silicone rubber in the elastic layer and the content of the fillers therein.

As described above, to control the orientation of each of the fillers in the elastic layer according to the present disclosure, an electric field is applied before the curing of the elastic layer. A step of applying an electric field to the elastic layer before the curing with a corona charger is described below.

After the layer of the liquid silicone rubber mixture containing the first filler, the second filler, and the addition-curable liquid silicone rubber has been formed on the outer peripheral surface of the substrate, the outer surface of the layer of the liquid silicone rubber mixture is charged.

Corona charging systems are classified into a scorotron system in which a grid electrode is present between a corona wire and a body to be charged, and a corotron system in which no grid electrode is present. Of those, a scorotron system is preferred from the viewpoint of the controllability of the surface potential of the body to be charged.

As illustrated in FIG. 3A and FIG. 3B, a corona charger 200 includes blocks 201 and 202, shields 203 and 204, and grids 206. In addition, a discharge wire 205 is tensioned between the block 201 and the block 202. A high voltage is applied to the discharge wire 205 by a high-voltage power supply (not shown), and an ion current obtained by discharge to the shields 203 and 204 is controlled by applying a high voltage to the grids 206. Thus, the surface of the uncured elastic layer 4 is charged. At this time, the substrate 3 or a core configured to hold the substrate 3 is grounded (not shown), and hence the control of the surface potential of the surface of the uncured elastic layer 4 enables a desired electric field to be generated in the elastic layer 4.

As illustrated in FIG. 3A, the corona charger 200 is arranged near the elastic layer 4 to face the layer along the width direction of the layer. Then, under a state in which a voltage is applied to the grids 206 of the corona charger 200 to cause the grids to discharge, the core 10 is rotated to rotate the substrate 3 having the uncured elastic layer 4 on its outer peripheral surface at, for example, 100 rpm for 20 seconds. Thus, the outer surface of the elastic layer 4 is charged. A distance between the outer surface of the elastic layer 4 and the grids 206 may be set to from 1 mm to 10 mm.

The surface of the elastic layer 4 is charged as described above to generate an electric field in the elastic layer. As a result, the fillers can be unevenly distributed.

The absolute value of the voltage to be applied to the grids 206 preferably falls within the range of from 0.1 kV or more to 3 kV or less, particularly the range of from 0.3 kV or more to 2 kV or less. When the sign of the voltage to be applied is set to be equal to the sign of the voltage to be applied to the wire, the same effect is obtained irrespective of whether the sign is negative or positive, though the direction of an electric field in the case of a negative sign is opposite to that in the case of a positive sign, and an AC voltage may be applied.

The range of potential control in the longitudinal direction of the surface of the elastic layer 4 is preferably a range above the paper passing region of the fixing member 100. For example, a configuration illustrated in FIG. 3A may be used, and when the voltage is applied to the grids 206 while the fixing member is rotated by using the central axis of the substrate 3 having the elastic layer 4 or the core 10 as a rotation axis during the application, the entirety of the elastic layer 4 may be charged. The number of revolutions of the fixing member is preferably set to from 10 rpm to 500 rpm, and a treatment time of 5 seconds or more is preferably set as a treatment time for the charging.

A material, such as stainless steel, nickel, molybdenum, or tungsten, may be appropriately used as the discharge wire 205. Of those, tungsten having extremely high stability among metals is preferably used. The shape of the discharge wire 205 to be tensioned inside the shields 203 and 204 is not particularly limited, and for example, a discharge wire having a shape like a saw tooth or such a discharge wire that a sectional shape when the wire is vertically cut is a circular shape (circular sectional shape) may be used. The diameter of the discharge wire 205 (in a cut surface when the wire is vertically cut) is preferably set to 40 μm or more and 100 μm or less. When the diameter of the discharge wire 205 is 40 μm or more, the breakage and tear of the discharge wire due to the collision of an ion caused by the discharge can be easily prevented. In addition, when the diameter of the discharge wire 205 is 100 μm or less, a moderate applied voltage can be applied to the discharge wire 205 at the time of the obtainment of stable corona discharge, and hence the occurrence of ozone can be easily prevented.

As illustrated in FIG. 3B, the flat plate-shaped grids 206 may be arranged between the discharge wire 205 and the elastic layer 4 arranged on the substrate 3. In this case, from the viewpoint that the charged potential of the surface of the elastic layer 4 is uniformized, the distance between the surface of the elastic layer 4 and the grids 206 is preferably set within the range of from 1 mm or more to 10 mm or less.

Thus, a desired surface potential is imparted to the surface of the elastic layer 4 on the substrate 3, and hence the desired electric field can be generated in the elastic layer 4.

(4) Adhesion Layer of Fixing Member

As illustrated in each of FIG. 7A and FIG. 7B, the adhesion layer 5 is a layer produced by bonding the elastic layer 4 and the surface layer 6 to each other with an addition-curable silicone rubber adhesive. An addition-curable silicone rubber blended with a self-adhesive component is preferably used as the adhesive. Specifically, the adhesive contains: an organopolysiloxane having a plurality of unsaturated aliphatic groups typified by a vinyl group in a molecular chain thereof, a hydrogen organopolysiloxane; and a platinum compound serving as a crosslinking catalyst. In addition, the adhesive is cured by an addition reaction. A known adhesive may be used as such adhesive.

Examples of the self-adhesive component include the following:

- a silane having at least one kind, preferably two or more kinds of functional groups selected from the group consisting of: an alkenyl group such as a vinyl group; a (meth)acryloxy group; a hydrosilyl group (SiH group); an epoxy group; an alkoxysilyl group; a carbonyl group; and a phenyl group;
- an organosilicon compound such as a cyclic or linear siloxane having 2 or more and 30 or less, preferably 4 or more and 20 or less silicon atoms; and
- a non-silicon-based organic compound (that is, an organic compound free of any silicon atom in a molecule thereof) that may have an oxygen atom in a molecule thereof, provided that the compound contains 1 or more and 4 or less, preferably 1 or more and 2 or less aromatic rings such as a monovalent or higher and tetravalent or lower, preferably divalent or higher and tetravalent or lower phenylene structure in a molecule thereof, and also contains at least 1, preferably 2 or more and 4 or less functional groups that may contribute to a hydrosilylation addition reaction (e.g., an alkenyl group or a (meth)acryloxy group) in a molecule thereof.

The above-mentioned self-adhesive components may be used alone or in combination thereof.

A filler component may be added to the adhesive from the viewpoints of the adjustment of its viscosity and the securement of its heat resistance to the extent that the addition does not deviate from the gist of present disclosure. Examples of the filler component include the following:

- silica, alumina, iron oxide, cerium oxide, cerium hydroxide, and carbon black.

Such addition-curable silicone rubber adhesive is commercially available, and is hence easily available.

The thickness of the adhesion layer is preferably 20 μm or less. When the thickness is set to 20 μm or less, at the time of the use of the fixing member in the heat fixing device, its heat resistance can be set to a small value, and hence heat from the inner surface side of the member can be efficiently transferred to a recording material.

(5) Surface Layer of Fixing Member

The surface layer 6 is formed of a fluorine resin, and for example, a product obtained by molding any one of the resins listed as examples below into a tube shape is used.

A tetrafluoroethylene-perfluoro(alkyl vinyl ether) copolymer (PFA), polytetrafluoroethylene (PTFE), and a tetrafluoroethylene-hexafluoropropylene copolymer (FEP).

Of the resin materials listed as examples above, a PFA is preferred from the viewpoints of moldability and toner releasability.

The thickness of the fluorine resin layer (surface layer) is preferably set to 10 μm or more and 50 μm or less. This is because when the layer is laminated, the wear resistance of the layer can be secured while the elasticity of the elastic layer below the layer is maintained, and hence the surface hardness of the fixing member is suppressed from becoming excessively high.

When the inner surface of the fluorine resin tube is subjected to sodium treatment, excimer laser treatment, ammonia treatment, or the like in advance, its adhesive property may be improved.

Figure 8:
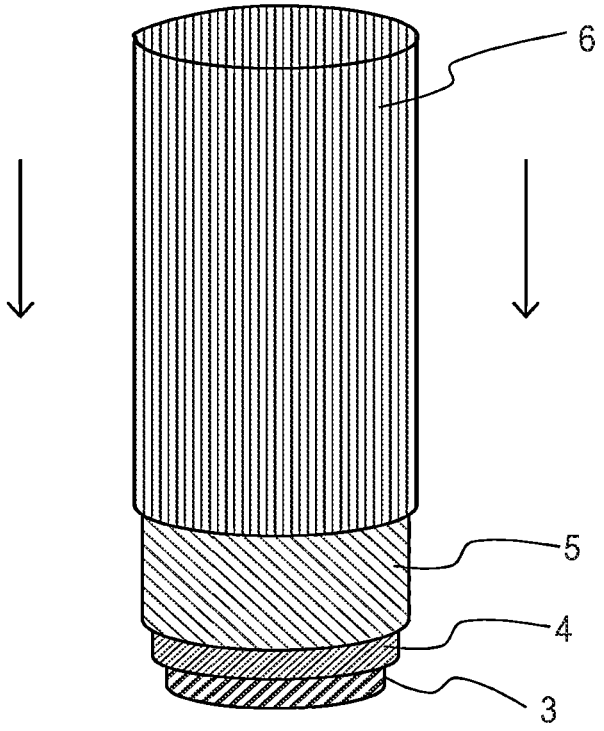
FIG. 8 is a schematic view of an example of a step of laminating a surface layer.

FIG. 8 is a schematic view of an example of a step of laminating the surface layer 6 on the silicone rubber-containing elastic layer 4 via the addition-curable silicone rubber adhesive.

The addition-curable silicone rubber adhesive is applied as the adhesion layer 5 to the surface of the elastic layer 4 formed on the outer peripheral surface of the substrate 3. Further, the outer surface of the adhesion layer 5 is covered with the fluorine resin tube serving as the surface layer 6 so that the surface layer is laminated on the adhesion layer.

Although a method for the covering is not particularly limited, for example, a method involving covering the outer surface through use of the addition-curable silicone rubber adhesive as a lubricant, or a method involving expanding the fluorine resin tube from its outside to cover the outer surface may be employed.

The redundant addition-curable silicone rubber adhesive remaining between the elastic layer 4 and the surface layer 6 is removed by being squeezed out with a unit (not shown). The thickness of the adhesion layer 5 after the squeezing is preferably set to 20 μm or less from the viewpoint of a heat transfer property.

Next, the addition-curable silicone rubber adhesive 5 is heated with a heating unit such as an electric furnace for a predetermined time period to be cured and to bond the elastic layer and the surface layer, and both end portions thereof are each cut into a desired length. Thus, the fixing member according to the present disclosure can be obtained.

(6) Method of Producing Fixing Member

A method of producing the fixing member having an endless shape according to one embodiment of the present disclosure may include, for example, the following steps of forming a silicone rubber-containing elastic layer:

(i) preparing a liquid silicone mixture containing a liquid silicone polymer and a first filler and a second filler, which are dispersed in the liquid silicone polymer;

(ii) forming a layer of the liquid silicone mixture on the surface of a substrate having an endless shape;

(iii) arranging a corona charger along the width direction of the substrate to face the surface of the layer of the liquid silicone mixture;

(iv) charging the surface of the layer of the liquid silicone mixture through use of the corona charger; and (v) curing the layer of the liquid silicone mixture to obtain the elastic layer.

In addition, the method of producing the fixing member according to this embodiment may include the following step:

(vi) laminating an adhesion layer and a surface layer (e.g., a fluorine resin surface layer) on the silicone rubber-containing elastic layer.

In the method of producing the fixing member of the present disclosure, the order of the steps may be appropriately set, and those steps may also be performed simultaneously (in parallel). When the surface layer is formed, the above-mentioned methods of forming the adhesion layer and the surface layer may be used.

(7) Heat Fixing Device

A heat fixing device according to one embodiment of the present disclosure includes a pair of heated rotating bodies like a roller and a roller, a belt and a roller, or a belt and a belt brought into pressure contact with each other. The kind of the heat fixing device is appropriately selected in consideration of conditions, such as a process speed and a size as the entire electrophotographic image forming apparatus to which the heat fixing device is mounted.

In the heat fixing device, a fixing member and a pressurizing member each of which has been heated are brought into press contact with each other to form a fixing nip N, and a recording medium S serving as a body to be heated, the recording medium having formed thereon images with unfixed toners, is interposed and conveyed into the fixing nip N. The images formed with the unfixed toners are referred to as "toner images "t"". Thus, the toner images "t" are heated and pressurized. As a result, the toner images "t" are melted and subjected to coloring mixing. After that, the toner images are cooled. Thus, an image is fixed onto the recording medium.

The configuration of the heat fixing device is described below by way of specific examples of the device, but the scope and applications of the present disclosure are not limited thereto.

(7-1) Heat Fixing Device of Fixing Belt-Pressurizing Belt System

Figure 9:
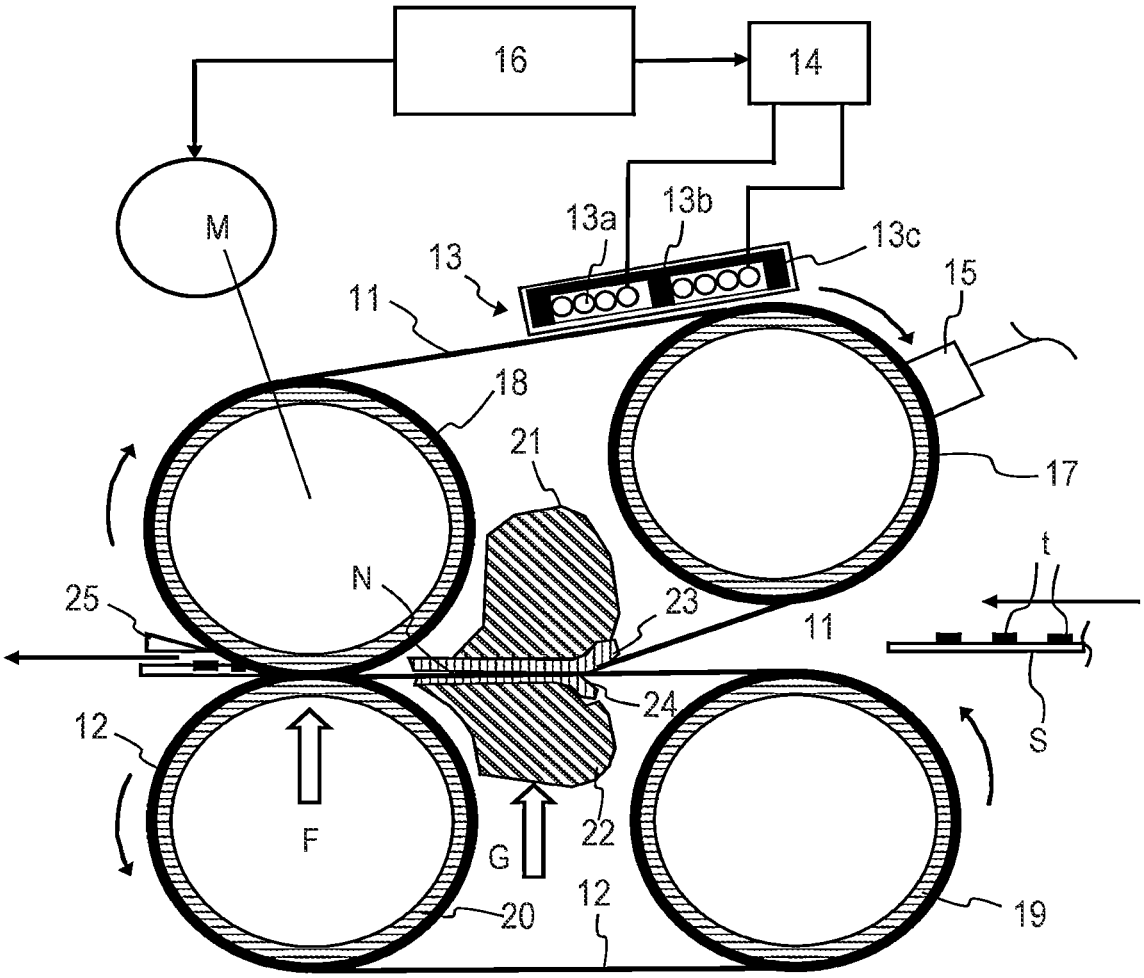
FIG. 9 is a schematic sectional view of an example of a heat fixing device of a fixing belt-pressurizing belt system.

FIG. 9 is a schematic sectional view of an example of a heat fixing device of a so-called twin-belt system in which a pair of rotating bodies like a fixing belt 11 and a pressurizing belt 12 is brought into press contact, the heat fixing device including the fixing belt as a fixing member.

The heat fixing device includes the fixing belt 11 serving as a fixing member and the pressurizing belt 12. The fixing belt 11 and the pressurizing belt 12 are each obtained by tensioning a fixing belt including a metal flexible substrate using nickel as a main component between two rollers.

A heat source that can perform heating by electromagnetic induction heating (an induction heating member or an exciting coil) having high energy efficiency is adopted as a unit for heating the fixing belt 11. An induction heating member 13 includes an induction coil 13*a*, an exciting core 13*b*, and a coil holder 13*c* configured to hold the coil and the core. The induction coil 13*a* uses a Litz wire flatly wound in an elliptical shape and is arranged in the horizontal E-shaped exciting core 13*b* protruding toward the center and both sides of the induction coil. A material having a high magnetic permeability and a low residual magnetic flux density, such as a ferrite or a permalloy, is used as a material for the exciting core 13*b*, and hence a loss in the induction coil 13*a* or the exciting core 13*b* can be suppressed and the fixing belt 11 can be efficiently heated.

When a high-frequency current is flowed from an exciting circuit 14 to the induction coil 13*a* of the induction heating member 13, the substrate of the fixing belt 11 causes induction heat generation and hence the fixing belt 11 is heated from a substrate side. The temperature of the surface of the fixing belt 11 is sensed by a temperature sensing element 15 such as a thermistor. A signal concerning the temperature of the fixing belt 11 sensed by the temperature sensing element 15 is sent to a control circuit portion 16. The control circuit portion 16 controls electric power supplied from the exciting circuit 14 to the induction coil 13*a* so that temperature information received from the temperature sensing element 15 may be maintained at a predetermined fixation temperature, to thereby adjust the temperature of the fixing belt 11 to the predetermined fixation temperature.

The fixing belt 11 is tensioned by a roller 17 and a heating side roller 18 serving as belt rotating members. The roller 17 and the heating side roller 18 are rotatably supported with bearings between the left and right side plates (not shown) of the device.

The roller 17 is, for example, a hollow roller made of iron having an outer diameter of 20 mm, an inner diameter of 18 mm, and a thickness of 1 mm, and functions as a tension roller for providing the fixing belt 11 with tension. The heating side roller 18 is, for example, a highly slidable elastic roller obtained by providing a mandrel made of an iron alloy having an outer diameter of 20 mm and an inner diameter of 18 mm with a silicone rubber layer serving as an elastic layer.

A driving force is input from a driving source (motor) M into the heating side roller 18 as a drive roller through a drive gear train (not shown), and hence the roller is rotationally driven in a clockwise direction indicated by the arrow at a predetermined speed. When the heating side roller 18 is provided with the elastic layer as described above, the driving force input into the heating side roller 18 can be satisfactorily transferred to the fixing belt 11, and a fixing nip for securing the separability of the recording medium from the fixing belt 11 can be formed. When the heating side roller 18 includes the elastic layer, a shortening effect on a warm-up time is exhibited because the layer reduces the conduction of heat into the heating side roller.

When the heating side roller 18 is rotationally driven, the fixing belt 11 rotates together with the roller 17 by virtue of friction between the silicone rubber surface of the heating side roller 18 and the inner surface of the fixing belt 11. The arrangement and sizes of the roller 17 and the heating side roller 18 are selected in accordance with the size of the fixing belt 11. For example, the dimensions of the roller 17 and the heating side roller 18 are selected so that the fixing belt 11 having an inner diameter of 55 mm when not mounted on the rollers may be tensioned therebetween.

The pressurizing belt 12 is tensioned by a tension roller 19 and a pressurization side roller 20 serving as belt rotating members. The inner diameter of the pressurizing belt when not mounted on the rollers is, for example, 55 mm. The tension roller 19 and the pressurization side roller 20 are rotatably supported with bearings between the left and right side plates (not shown) of the device.

For example, the tension roller 19 is obtained by providing a mandrel made of an iron alloy having an outer diameter of 20 mm and an inner diameter of 16 mm with a silicone sponge layer for reducing a thermal conductivity to reduce the conduction of heat from the pressurizing belt 12.

The pressurization side roller 20 is, for example, a lowly slidable rigid roller made of an iron alloy having an outer diameter of 20 mm, an inner diameter of 16 mm, and a thickness of 2 mm. The dimensions of the tension roller 19 and the pressurization side roller 20 are similarly selected in accordance with the dimensions of the pressurizing belt 12.

In this case, in order that a fixing nip portion N may be formed between the fixing belt 11 and the pressurizing belt 12, both the left and right end sides of the rotation axis of the pressurization side roller 20 are pressurized toward the heating side roller 18 with a predetermined pressurizing force in a direction indicated by the arrow F by a pressurizing mechanism (not shown).

In addition, the following pressurizing pads are adopted for obtaining the wide fixing nip portion N without increasing the size of the device: a fixing pad 21 serving as a first pressurizing pad for pressurizing the fixing belt 11 toward the pressurizing belt 12; and a pressurizing pad 22 serving as a second pressurizing pad for pressurizing the pressurizing belt 12 toward the fixing belt 11. The fixing pad 21 and the pressurizing pad 22 are supported and arranged between the left and right side plates (not shown) of the device. The pressurizing pad 22 is pressurized toward the fixing pad 21 with a predetermined pressurizing force in a direction indicated by the arrow G by a pressurizing mechanism (not shown). The fixing pad 21 serving as the first pressurizing pad includes a pad substrate and a sliding sheet (low friction sheet) 23 in contact with the belt. The pressurizing pad 22 serving as the second pressurizing pad also includes a pad substrate and a sliding sheet 24 in contact with the belt. This is because there is a problem in that the shaving of a portion of the pad that rubs against the inner peripheral surface of the belt increases. When each of the sliding sheets 23 and 24 is interposed between the belt and the pad substrate, the shaving of the pad can be prevented and the sliding resistance of the belt can be reduced, and hence a good belt traveling property and good belt durability can be secured.

The fixing belt is provided with a non-contact antistatic brush (not shown) and the pressurizing belt is provided with a contact antistatic brush (not shown).

The control circuit portion 16 drives a motor M at least at the time of the performance of image formation. Thus, the heating side roller 18 is rotationally driven and the fixing belt 11 is rotationally driven in the same direction. The pressurizing belt 12 rotates following the fixing belt 11. In this case, the most downstream portion of the fixing nip has such a configuration that the recording medium is conveyed while the fixing belt 11 and the pressurizing belt 12 are sandwiched between a pair of the rollers 18 and 20, and hence the belts can be prevented from slipping. The most downstream portion of the fixing nip is a portion in which a pressure distribution in the fixing nip (in the direction in which the recording medium is conveyed) becomes maximum.

Under a state in which the temperature of the fixing belt 11 is increased to the predetermined fixation temperature and maintained (that is, the temperature is controlled), the recording medium S having the unfixed toner images "t" is conveyed into the fixing nip portion N between the fixing belt 11 and the pressurizing belt 12. The recording medium S is introduced with its surface bearing the unfixed toner images "t" directed toward the fixing belt 11. Then, the unfixed toner images "t" of the recording medium S are interposed and conveyed while closely adhering to the outer peripheral surface of the fixing belt 11. Thus, heat is applied from the fixing belt 11 to the images and the images receive a pressurizing force to be fixed onto the surface of the recording medium S. At this time, heat from the heated substrate of the fixing belt 11 is efficiently transported toward the recording medium S through the elastic layer improved in thermal conductivity in its thickness direction. After that, the recording medium S is separated from the fixing belt by a separating member 25 and conveyed.

(7-2) Heat Fixing Device of Fixing Belt-Pressurizing Roller System

Figure 10:
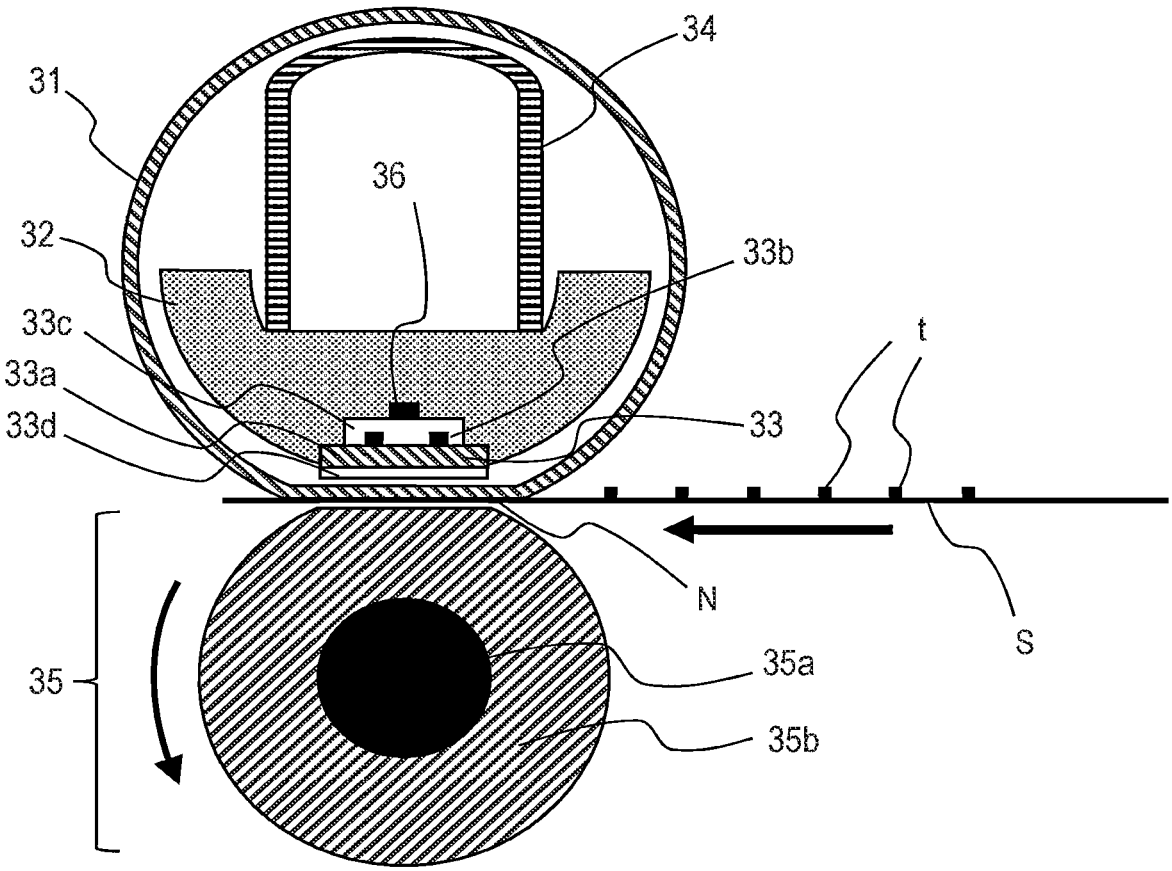
FIG. 10 is a schematic sectional view of an example of a heat fixing device of a fixing belt-pressurizing roller system.

FIG. 10 is a schematic view for illustrating an example of a heat fixing device of a fixing belt-pressurizing roller system using a ceramic heater as a heating body. In FIG. 10, a fixing belt 31 is a fixing belt having a cylindrical shape or an endless belt shape, and uses the fixing member according to the present disclosure. A heat-resistant and heat-insulating belt guide 32 for holding the fixing belt 31 is present, and at a position in contact with the fixing belt 31 (substantially the central portion of the lower surface of the belt guide 32), a ceramic heater 33 configured to heat the fixing belt 31 is fixed and supported by being fitted into a groove portion formed and provided along the longitudinal direction of the guide. In addition, the fixing belt 31 is loosely fitted onto the belt guide 32. In addition, a rigid stay 34 for pressurization is inserted into the belt guide 32.

Meanwhile, a pressurizing roller 35 is arranged so as to face the fixing belt 31. In this example, the pressurizing roller 35 is an elastic pressurizing roller, that is, an elastic layer **35*b* of a silicone rubber is arranged on a mandrel 35*a* to reduce its hardness, and the roller is arranged by rotatably holding both end portions of the mandrel 35*a*** with bearings between chassis side plates on the front side and rear side (not shown) of the device. The elastic pressurizing roller is covered with a tetrafluoroethylene-perfluoroalkyl ether copolymer (PFA) tube for improving its surface property.

A pressurizing spring (not shown) is contractedly arranged between each of both end portions of the rigid stay 34 for pressurization and a spring-receiving member (not shown) on a device chassis side to apply a depression force to the rigid stay 34 for pressurization. Thus, the lower surface of the ceramic heater 33 arranged on the lower surface of the belt guide 32 made of a heat-resistant resin and the upper surface of the pressurizing roller 35 are brought into press contact with each other with the fixing belt 31 sandwiched therebetween to form the fixing nip portion N.

The pressurizing roller 35 is rotationally driven in a counterclockwise direction as indicated by the arrow by a driving unit (not shown). A frictional force between the pressurizing roller 35 and the outer surface of the fixing belt 31 caused by the rotational driving of the pressurizing roller 35 applies a rotational force to the fixing belt 31. Then, the fixing belt 31 rotates outside the belt guide 32 in a clockwise direction as indicated by the arrow at a peripheral speed substantially corresponding to the rotational peripheral speed of the pressurizing roller 35 while its inner surface slides under a state of being in close contact with the lower surface of the ceramic heater 33 in the fixing nip portion N (pressurizing roller driving system).

The rotation of the pressurizing roller 35 is started and the heat-up of the ceramic heater 33 is started based on a print start signal. At the instant when the peripheral speed of the rotation of the fixing belt 31 by the rotation of the pressurizing roller 35 is made steady, and the temperature of a temperature sensing element 36 arranged on the upper surface of the ceramic heater 33 rises up to a predetermined temperature, for example, 180° C., the recording material S bearing the unfixed toner images "t", which serves as a material to be heated, is introduced between the fixing belt 31 and the pressurizing roller 35 in the fixing nip portion N with its toner image-bearing surface side directed toward the fixing belt 31. Then, the recording medium S comes into close contact with the lower surface of the ceramic heater 33 in the fixing nip portion N via the fixing belt 31, and moves and passes through the fixing nip portion N together with the fixing belt 31. In the moving and passing process, the heat of the fixing belt 31 is applied to the recording material S to heat the toner images "t" and to fix the images onto the surface of the recording material S. The recording medium S that has passed through the fixing nip portion N is separated from the outer surface of the fixing belt 31 and conveyed.

The ceramic heater 33 serving as a heating body is a low-heat capacity and oblong linear heating body whose longitudinal direction is the direction perpendicular to the moving direction of the fixing belt 31 and the recording medium S. The basic configuration of the ceramic heater 33 is preferably as follows: the heater includes a heater substrate 33*a*, heat-generating layers 33*b* arranged on the surface of the heater substrate 33*a* along its longitudinal direction, a protective layer 33*c* arranged on the layers, and a sliding member 33*d*. In this case, the heater substrate 33*a* may include, for example, aluminum nitride. The heat-generating layers 33*b* may each be formed by applying an electrical resistance material such as a silver-palladium (Ag—Pd) alloy through screen printing or the like so that the material may have a thickness of about 10 μm and a width of from 1 mm to 5 mm. The protective layer 33*c* may include glass, a fluorine resin, or the like. The ceramic heater to be used in the heat fixing device is not limited to such heater.

Then, when an electric current is flowed between both ends of each of the heat-generating layers 33*b* of the ceramic heater 33, the heat-generating layers 33*b* generate heat, and hence the temperature of the heater 33 rapidly increases. The ceramic heater 33 is fixed and supported by being fitted into the groove portion formed and provided in substantially the central portion of the lower surface of the belt guide 32 along the longitudinal direction of the guide with its protective layer 33*c* side directed upward. In the fixing nip portion N in contact with the fixing belt 31, the surface of the sliding member 33*d* of the ceramic heater 33 and the inner surface of the fixing belt 31 slide while being in contact with each other.

As described above, the fixing belt 31 improves the thermal conductivity of the silicone rubber-containing elastic layer in its thickness direction, and suppresses the hardness of the layer to a low level. With such configuration, the fixing belt 31 can efficiently heat the unfixed toner images "t", and can fix a high-quality image to the recording material S at the time of its passing through the fixing nip because of the low hardness.

As described above, according to one aspect of the present disclosure, there is provided the heat fixing device having arranged therein the fixing member. Accordingly, the heat fixing device having arranged therein the fixing member excellent in fixing performance and image quality can be provided.

According to one aspect of the present disclosure, there is provided the fixing member that is further improved in thermal conductivity in its thickness direction. In addition, according to another aspect of the present disclosure, there is provided the heat fixing device conducive to more efficient formation of a high-quality electrophotographic image, the device including the fixing member.

EXAMPLES

The present disclosure is described in more detail below by way of Examples.

First, a method of measuring the repose angle of a filler is described. The measurement was performed with a powder characteristic-evaluating apparatus (product name: POWDER TESTER PT-X, manufactured by Hosokawa Micron Corporation) under the following conditions.

Sieve: opening: 150 μm, wire diameter: 100 μm
Amplitude: 0.5 mm
Vibration time: 1,800 seconds or more (until the filler drops at the periphery of 360° of the plate)
Slow down time: 10 seconds

Example 1

(1) Chamfering Treatment and Classification of Metal Silicon Filler

A metal silicon filler (product name: #350WB, manufactured by Kinsei Matec Co., Ltd.) was loaded into HYBRIDIZATION SYSTEM NHS-1 (manufactured by Nara Machinery Co., Ltd.), and was subjected to chamfering treatment at a peripheral speed of 100 m/s (a rotational speed of 8,300 $min^{-1}$) in an argon (Ar) atmosphere serving as an inert gas atmosphere for 15 minutes.

Next, the metal silicon filler subjected to the chamfering treatment was classified with a classifier (product name: MDX-3, manufactured by Nippon Pneumatic Mfg. Co., Ltd.) with a view to removing particles each having a particle diameter of 5 μm or less. The classified filler was subjected to measurement with a particle diameter distribution-measuring apparatus (product name: MICROTRAC MT3300II EX, manufactured by MicrotracBEL Corp.). As a result, the filler had a minimum particle diameter Do of 4.2 μm. In addition, the classified filler had a repose angle of 42°.

(2) Preparation of Addition-Curable Liquid Silicone Rubber Mixture

First, 100 parts by mass of an addition-curable liquid silicone rubber (product name: DMS-V35, manufactured by Gelest Inc., viscosity: 5,000 $mm^2/s$), which had vinyl groups serving as unsaturated aliphatic groups only at both the terminals of a molecular chain thereof and further had a methyl group serving as an unsubstituted hydrocarbon group free of any unsaturated aliphatic group, was prepared as the component (a). The liquid silicone rubber is hereinafter also described as "Vi". The liquid silicone rubber has a structure represented by the structural formula 2, and $R_3$s each represent a methyl group and $R_4$s each represent a vinyl group.

Next, the Vi was blended with magnesium oxide (product name: PSF-WR, manufactured by Konoshima Chemical Co., Ltd., average particle diameter: 1 μm) serving as a first filler so that its amount became 10 vol % with respect to the silicone component. Further, the blend was blended with the metal silicon filler serving as a second filler, which had been subjected to the chamfering and classification treatments in the section (1), so that its amount became 33 vol % with respect to the silicone component, followed by sufficient mixing. Thus, a mixture 1 was obtained.

The fillers are formed only of the first filler and the second filler, and hence the proportion of the sum of the first filler and the second filler to the total amount of the fillers is 100%.

Next, a solution obtained by dissolving 0.2 part by mass of 1-ethynyl-1-cyclohexanol (manufactured by Tokyo Chemical Industry Co., Ltd.) serving as a curing retarder in the same weight of toluene was added as the component (d) to the mixture 1. Thus, a mixture 2 was obtained.

Next, 0.1 part by mass of a hydrosilylation catalyst (platinum catalyst: a mixture of a 1,3-divinyltetramethyldisiloxane platinum complex, 1,3-divinyltetramethyldisiloxane, and 2-propanol) was added as the component (c) to the mixture 2. Thus, a mixture 3 was obtained.

Further, 1.1 parts by mass of a silicone polymer having a linear siloxane skeleton and having an active hydrogen group bonded to silicon only in a side chain thereof (product name: HMS-301, manufactured by Gelest, Inc., viscosity: 30 $mm^2/s$) was weighed as the component (b). The polymer was added to the mixture 3, and the whole was sufficiently mixed to provide an addition-curable liquid silicone rubber mixture.

(3) Production of Fixing Belt

Next, a fixing belt was produced by using the resultant addition-curable liquid silicone rubber mixture containing the first filler and the second filler as described below.

A nickel electrocast endless sleeve having an inner diameter of 30 mm, a width of 400 mm, and a thickness of 40 μm was prepared as a substrate. In a series of production steps, the endless sleeve was handled while a core was inserted thereinto.

First, a primer (product name: DY39-051 A/B, manufactured by Dow Corning Toray Co., Ltd.) was applied to the outer peripheral surface of the substrate in a substantially uniform manner. After the solvent had been dried, baking treatment was performed in an electric furnace at 160° C. for 30 minutes.

The silicone rubber mixture was applied onto the substrate subjected to the primer treatment by a ring coating method so that its thickness became 250 μm. The resultant is referred to as "uncured endless sleeve."

Next, a corona charger was arranged to face the uncured endless sleeve along the generating line thereof, and the longitudinal direction of the corona charger was arranged substantially parallel to the width direction (longitudinal direction) of the uncured endless sleeve. Then, while the uncured endless sleeve was rotated at 141 rpm, an AC electric field was applied to the surface of its elastic layer before curing. The application was performed under the following conditions: a current to be supplied to the wire of the corona charger was an AC current (square wave) having a frequency of 0.2 Hz, and positive and negative peak values of ±150 μA; a grid electrode potential was an AC voltage (square wave) having a frequency of 0.2 Hz, and positive and negative peak values of ±300 V; a charging time was 100 seconds; and a distance between a grid electrode and the core inserted into the uncured endless sleeve was 3 mm.

The uncured endless sleeve that had been charged was heated in an electric furnace at 160° C. for 1 minute (primary curing). After that, the sleeve was heated in an electric furnace at 200° C. for 30 minutes (secondary curing) so that the silicone rubber mixture layer was cured. Thus, an endless belt including an elastic layer was obtained.

Next, while the surface of the resultant endless belt was rotated in its peripheral direction at a moving speed of 20 mm/sec, a UV lamp placed at a distance of 10 mm from the surface was used to apply UV light to the surface of the elastic layer. A low-pressure mercury UV lamp (product name: GLQ500US/11, manufactured by Toshiba Lighting & Technology Corporation (formerly Harison Toshiba Lighting Corporation)) was used as the UV lamp, and the application was performed in an air atmosphere at room temperature for 6 minutes.

Next, an addition-curable silicone rubber adhesive (product name: SE1819CV A/B, manufactured by Dow Corning Toray Co., Ltd.) was applied to the surface of the elastic layer of the endless belt in a substantially uniform manner so as to have a thickness of 20 μm.

Next, a fluorine resin tube having an inner diameter of 29 mm and a thickness of 30 μm (product name: KURANFLON-LT, manufactured by Kurabo Industries Ltd.) was laminated on the adhesive. After that, the belt was uniformly squeezed from above the fluorine resin tube. Thus, the redundant adhesive was squeezed out of a space between the elastic layer and the fluorine resin tube so as to be sufficiently thin.

The resultant endless belt was heated in an electric furnace at 200° C. for 1 hour. Thus, the adhesive was cured to fix a surface layer formed of the fluorine resin tube on the elastic layer. Both the end portions of the resultant endless belt were cut. Thus, a fixing belt having a width of 341 mm was obtained.

(4) Evaluation of Elastic Layer of Fixing Belt (4-1) Evaluation of Uneven Distribution of Fillers by Average of Representative Coefficients of Variation of Inter-Surface Distance Between Fillers Six measurement samples were cut out of 6 arbitrary sites of the produced fixing belt, and a section of each of the samples in a direction perpendicular to the peripheral direction of the fixing belt, that is, a section thereof in the thickness-MD directions of the elastic layer was subjected to polishing processing with an ion beam. A cross section polisher (product name: SM-09010, manufactured by JEOL Ltd.) was used in the polishing processing. The polishing processing was performed in an Ar gas atmosphere by setting an applied voltage to 4.5 V and applying an ion beam from a substrate side in the thickness direction of the fixing belt over 11 hours.

Next, the surface of each measurement sample subjected to the polishing processing was observed by using the above-mentioned method with a SEM (product name: FE-SEM SIGMA500 VP, manufactured by Carl Zeiss AG). Thus, a sectional image was obtained.

Each of the resultant 6 sectional images was subjected to binarization processing with image processing software "ImageJ". Otsu's method was used as a binarization method. Next, the representative coefficient A of variation of an inter-surface distance between the fillers in the thickness direction of the elastic layer in each image was determined by the above-mentioned method, and the average of the determined values was calculated. As a result, the average was 1.79. In addition, the representative coefficient B of variation of an inter-surface distance between the fillers in the direction (MD) perpendicular to the peripheral direction of the fixing member in each image was determined by the above-mentioned method, and the average of the determined values was calculated. As a result, the average was 1.53.

(4-2) Circle-Equivalent Diameters and Area Proportions of Fillers

A first image in which only the first filler was sampled and a second image in which only the second filler was sampled were obtained for each of the 6 sectional SEM images obtained in the section (4-1) by the above-mentioned method, and the circle-equivalent diameters of the respective fillers were calculated. As a result, the average of the circle-equivalent diameters of magnesium oxide serving as the first filler was 1 μm, and the maximum thereof was less than 4 μm. In addition, the average of the circle-equivalent diameters of metal silicon serving as the second filler was 18 μm, and circle-equivalent diameters of 5 μm or more accounted for 98% or more thereof.

In addition, the area proportions of the fillers were determined by the above-mentioned method. As a result, the area proportions of the first filler and the second filler were 10% and 33%, respectively. The area proportion of each of the fillers is identical in meaning to the volume blending proportion of the filler. Accordingly, the content of the first filler with respect to the elastic layer was 10 vol %, and the content of the second filler with respect thereto was 33 vol %, and the content of the fillers (first filler+second filler) with respect to the elastic layer was 43 vol %.

(4-3) Thermal Conductivity of Elastic Layer in Thickness Direction

The thermal conductivity λ of the elastic layer in its thickness direction was calculated from the following equation:

$$\lambda=\alpha\times C_p\times\rho$$

where λ represents the thermal conductivity of the elastic layer in the thickness direction (W/(m·K)), α represents a thermal diffusivity in the thickness direction ($m^2/s$), $C_p$ represents a specific heat at constant pressure (J/(kg·K)), and ρ represents a density ($kg/m^3$). Herein, the values of the thermal diffusivity α in the thickness direction, the specific heat at constant pressure $C_p$, and the density ρ were determined by the following methods.

Thermal Diffusivity α

The thermal diffusivity α of the elastic layer in the thickness direction was measured with a periodical heating method thermal diffusivity measurement system (product name: FTC-1, manufactured by ADVANCE RIKO, Inc.) at room temperature (25° C.). A sample piece having an area measuring 8 mm by 12 mm was cut out of the elastic layer with a cutter, and a total of 5 sample pieces were produced. The thicknesses of the respective sample pieces were measured with a digital length measuring system (product name: DIGIMICRO MF-501, manufactured by Nikon Corporation, flat probe Φ4 mm). Next, the thermal diffusivity of each of the sample pieces was measured a total of 5 times, and the average ($m^2/s$) of the measured values was determined. The measurement was performed while the sample piece was pressurized with a weight of 1 kg.

As a result, the thermal diffusivity α of the elastic layer in the thickness direction was $10.7\times10^{-7}$ $m^2/s$.

Specific Heat at Constant Pressure $C_p$

The specific heat at constant pressure of the elastic layer was measured with a differential scanning calorimeter (product name: DSC823e, manufactured by Mettler-Toledo).

Specifically, pans made of aluminum were used as a pan for a sample and a reference pan. First, as blank measurement, under a state in which both the pans were empty, measurement was performed by the following program: a temperature in the calorimeter was kept constant at 15° C. for 10 minutes, was then increased to 215° C. at a rate of temperature increase of 10° C./min, and was kept constant at 215° C. for 10 minutes. Next, measurement was performed through use of 10 mg of synthetic sapphire whose specific heat at constant pressure was known as a reference substance by the same program. Next, the same amount of a measurement sample as that of the synthetic sapphire serving as the reference substance, that is, 10 mg thereof was cut out of the elastic layer. After that, the sample was set in the sample pan, and measurement was performed by the same program. Those measurement results were analyzed with specific heat analysis software attached to the differential scanning calorimeter, and the specific heat at constant pressure $C_p$ at 25° C. was calculated from the average of the 5 measurement results.

As a result, the specific heat at constant pressure of the elastic layer was 1.05 J/(g·K).

Density ρ

The density of the elastic layer was measured with a dry automatic densimeter (product name: ACCUPYC 1330-01, manufactured by Shimadzu Corporation).

Specifically, a sample cell having a volume of 10 $cm^3$ was used, and a sample piece was cut out of the elastic layer so as to account for about 80% of the volume of the cell. The mass of the sample piece was measured, and then the sample piece was loaded into the sample cell. The sample cell was set in a measuring portion in the apparatus. Helium was used as a gas for measurement, and the cell was purged with the gas. After that, the volume of the sample piece was measured 10 times. The density of the elastic layer was calculated from the mass of the sample piece and the measured volume for each measurement, and the average of the calculated values was determined.

As a result, the density of the elastic layer was 1.68 $g/cm^3$.

The thermal conductivity λ of the elastic layer in the thickness direction was calculated from the specific heat at constant pressure $C_p$ (J/(kg·K)) and density ρ ($kg/m^3$) of the elastic layer each of which had been subjected to unit conversion, and the measured thermal diffusivity α ($m^2/s$). As a result, the thermal conductivity was 1.9 W/(m·K).

Example 2

(1) Classification of Metal Silicon Filler

A metal silicon filler (product name: #350WB, manufactured by Kinsei Matec Co., Ltd.) was classified with a classifier (MDX-3, manufactured by Nippon Pneumatic Mfg. Co., Ltd.) with a view to removing particles each having a particle diameter of 5 μm or less. The classified filler was subjected to measurement with a particle diameter distribution-measuring apparatus (MICROTRAC MT3300II EX, manufactured by MicrotracBEL Corp.). As a result, the filler had a minimum particle diameter $D_0$ of 3.6 μm. In addition, the classified filler had a repose angle of 57°.

(2) Preparation of Addition-Curable Liquid Silicone Rubber Mixture

An addition-curable liquid silicone rubber mixture was obtained in the same manner as in Example 1 except that the metal silicon filler classified in the section (1) was blended as a second filler.

(3) Production of Fixing Belt

A fixing belt was obtained in the same manner as in Example 1 except that the above-mentioned silicone rubber mixture was used.

(4) Evaluation of Elastic Layer of Fixing Belt (4-1) Evaluation of Uneven Distribution of Fillers by Average of Representative Coefficients of Variation of Inter-Surface Distance Between Fillers The representative coefficient A of variation of an inter-surface distance between the fillers in the thickness direction of the elastic layer of the fixing belt in each image was determined in the same manner as in Example 1, and the average of the determined values was calculated. As a result, the average was 1.43. In addition, the representative coefficient of variation B of an inter-surface distance between the fillers in the direction (MD) perpendicular to the peripheral direction of the fixing member in each image was determined, and the average of the determined values was calculated. As a result, the average was 1.23.

(4-2) Circle-Equivalent Diameters and Area Proportions of Fillers

The circle-equivalent diameters of the respective fillers were calculated in the same manner as in Example 1. As a result, the average of the circle-equivalent diameters of magnesium oxide serving as the first filler was 1 μm, and the maximum thereof was less than 4 km. In addition, the average of the circle-equivalent diameters of metal silicon serving as the second filler was 15 μm, and circle-equivalent diameters of 5 μm or more accounted for 96% or more thereof.

In addition, the area proportions of the fillers were determined in the same manner as in Example 1. As a result, the area proportions of the first filler and the second filler were 10% and 33%, respectively. Accordingly, the content of the first filler with respect to the elastic layer was 10 vol %, and the content of the second filler with respect thereto was 33 vol %, and the content of the fillers (first filler+second filler) with respect to the elastic layer was 43 vol %.

(4-3) Thermal Conductivity of Elastic Layer in Thickness Direction

The thermal conductivity λ of the elastic layer in the thickness direction was calculated in the same manner as in Example 1. As a result, the thermal conductivity was 1.7 W/(m·K).

Example 3

(1) Chamfering Treatment and Classification of Metal Silicon Filler

A metal silicon filler (product name: #350WB, manufactured by Kinsei Matec Co., Ltd.) was loaded into HYBRIDIZATION SYSTEM NHS-1 (manufactured by Nara Machinery Co., Ltd.), and was subjected to chamfering treatment at a peripheral speed of 100 m/s (a rotational speed of 8,300 $min^{-1}$) in an air atmosphere for 15 minutes.

Next, the metal silicon filler subjected to the chamfering treatment was classified with a classifier (MDX-3, manufactured by Nippon Pneumatic Mfg. Co., Ltd.) with a view to removing particles each having a particle diameter of 5 μm or less. The classified filler was subjected to measurement with a particle diameter distribution-measuring apparatus (MICROTRAC MT3300II EX, manufactured by MicrotracBEL Corp.). As a result, the filler had a minimum particle diameter $D_0$ of 4.2 μm. In addition, the classified filler had a repose angle of 41°.

(2) Preparation of Liquid Addition-Curable Silicone Rubber Mixture

Magnesium oxide (product name: PSF-WR, manufactured by Konoshima Chemical Co., Ltd., average particle diameter: 1 μm) was blended as a first filler so that its amount became 12 vol % with respect to the silicone component. Further, the metal silicon filler subjected to the chamfering and classification treatments in the section (1) was blended as a second filler so that its amount became 31 vol % with respect to the silicone component. A liquid addition-curable silicone rubber mixture was obtained in the same manner as in Example 1 except the foregoing.

(3) Production of Fixing Belt

A fixing belt was obtained in the same manner as in Example 1 except that the above-mentioned silicone rubber mixture was used.

(4) Evaluation of Elastic Layer of Fixing Belt (4-1) Evaluation of Uneven Distribution of Fillers by Average of Representative Coefficients of Variation of Inter-Surface Distance Between Fillers The representative coefficient A of variation of an inter-surface distance between the fillers in the thickness direction of the elastic layer of the fixing belt in each image was determined in the same manner as in Example 1, and the average of the determined values was calculated. As a result, the average was 1.94. In addition, the representative coefficient B of variation of an inter-surface distance between the fillers in the direction (MD) perpendicular to the peripheral direction of the fixing member in each image was determined, and the average of the determined values was calculated. As a result, the average was 1.45.

(4-2) Circle-Equivalent Diameters and Area Proportions of Fillers

The circle-equivalent diameters of the respective fillers were calculated in the same manner as in Example 1. As a result, the average of the circle-equivalent diameters of magnesium oxide serving as the first filler was 1 μm, and the maximum thereof was less than 4 μm. In addition, the average of the circle-equivalent diameters of metal silicon serving as the second filler was 14 μm, and circle-equivalent diameters of 5 μm or more accounted for 98% or more thereof.

In addition, the area proportions of the fillers were determined in the same manner as in Example 1. As a result, the area proportions of the first filler and the second filler were 12% and 31%, respectively. Accordingly, the content of the first filler with respect to the elastic layer was 12 vol %, and the content of the second filler with respect thereto was 31 vol %, and the content of the fillers (first filler+second filler) with respect to the elastic layer was 43 vol %.

(4-3) Thermal Conductivity of Elastic Layer in Thickness Direction

The thermal conductivity λ of the elastic layer in the thickness direction was calculated in the same manner as in Example 1. As a result, the thermal conductivity was 1.8 W/(m·K).

Example 4

(1) Chamfering Treatment and Classification of Metal Silicon Filler

Chamfering treatment and classification were performed in the same manner as in Example 3.

(2) Preparation of Liquid Addition-Curable Silicone Rubber Mixture

Magnesium oxide (product name: PSF-WR, manufactured by Konoshima Chemical Co., Ltd., average particle diameter: 1 μm) was blended as a first filler so that its amount became 8 vol % with respect to the silicone component. Further, the metal silicon filler subjected to the chamfering and classification treatments in the section (1) was blended as a second filler so that its amount became 35 vol % with respect to the silicone component. A liquid addition-curable silicone rubber mixture was obtained in the same manner as in Example 1 except the foregoing.

(3) Production of Fixing Belt

A fixing belt was obtained in the same manner as in Example 1 except that the above-mentioned silicone rubber mixture was used.

(4) Evaluation of Elastic Layer of Fixing Belt (4-1) Evaluation of Uneven Distribution of Fillers by Average of Representative Coefficients A and B of Variation of Inter-Surface Distance Between Fillers The representative coefficient A of variation of an inter-surface distance between the fillers in the thickness direction of the elastic layer of the fixing belt in each image was determined in the same manner as in Example 1, and the average of the determined values was calculated. As a result, the average was 1.83. In addition, the representative coefficient B of variation of an inter-surface distance between the fillers in the direction (MD) perpendicular to the peripheral direction of the fixing member in each image was determined, and the average of the determined values was calculated. As a result, the average was 1.45.

(4-2) Circle-Equivalent Diameters and Area Proportions of Fillers

The circle-equivalent diameters of the respective fillers were calculated in the same manner as in Example 1. As a result, the average of the circle-equivalent diameters of magnesium oxide serving as the first filler was 1 μm, and the maximum thereof was less than 4 μm. In addition, the average of the circle-equivalent diameters of metal silicon serving as the second filler was 14 μm, and circle-equivalent diameters of 5 μm or more accounted for 98% or more thereof.

In addition, the area proportions of the fillers were determined in the same manner as in Example 1. As a result, the area proportions of the first filler and the second filler were 8% and 35%, respectively. Accordingly, the content of the first filler with respect to the elastic layer was 8 vol %, and the content of the second filler with respect thereto was 35 vol %, and the content of the fillers (first filler+second filler) with respect to the elastic layer was 43 vol %.

(4-3) Thermal Conductivity of Elastic Layer in Thickness Direction

The thermal conductivity λ of the elastic layer in the thickness direction was calculated in the same manner as in Example 1. As a result, the thermal conductivity was 1.6 W/(m·K).

Comparative Example 1

(1) Chamfering Treatment and Classification of Metal Silicon Filler

Chamfering treatment and classification were performed in the same manner as in Example 1.

(2) Preparation of Liquid Addition-Curable Silicone Rubber Mixture

A liquid addition-curable silicone rubber mixture was obtained in the same manner as in Example 1.

(3) Production of Fixing Belt

A fixing belt was obtained in the same manner as in Example 1 except that the surface of the elastic layer before the curing of the rubber was not charged with a corona charger.

(4) Evaluation of Elastic Layer of Fixing Belt (4-1) Evaluation of Uneven Distribution of Fillers by Average of Representative Coefficients A and B of Variation of Inter-Surface Distance Between Fillers The representative coefficient A of variation of an inter-surface distance between the fillers in the thickness direction of the elastic layer of the fixing belt in each image was determined in the same manner as in Example 1, and the average of the determined values was calculated. As a result, the average was 1.32. In addition, the representative coefficient B of variation of an inter-surface distance between the fillers in the direction (MD) perpendicular to the peripheral direction of the fixing member in each image was determined, and the average of the determined values was calculated. As a result, the average was 1.33.

(4-2) Circle-Equivalent Diameters and Area Proportions of Fillers

The circle-equivalent diameters of the respective fillers were calculated in the same manner as in Example 1. As a result, the average of the circle-equivalent diameters of magnesium oxide serving as the first filler was 1 μm, and the maximum thereof was less than 4 μm. In addition, the average of the circle-equivalent diameters of metal silicon serving as the second filler was 18 μm, and circle-equivalent diameters of 5 μm or more accounted for 98% or more thereof.

In addition, the area proportions of the fillers were determined in the same manner as in Example 1. As a result, the area proportions of the first filler and the second filler were 10% and 33%, respectively. Accordingly, the content of the first filler with respect to the elastic layer was 10 vol %, and the content of the second filler with respect thereto was 33 vol %, and the content of the fillers (first filler+second filler) with respect to the elastic layer was 43 vol %.

(4-3) Thermal Conductivity of Elastic Layer of Fixing Belt in Thickness Direction The thermal conductivity λ of the elastic layer in the thickness direction was calculated in the same manner as in Example 1. As a result, the thermal conductivity was 1.1 W/(m·K).

Comparative Example 2

(1) Classification of Metal Silicon Filler

Classification was performed in the same manner as in Example 2.

(2) Preparation of Liquid Addition-Curable Silicone Rubber Mixture

A liquid addition-curable silicone rubber mixture was obtained in the same manner as in Example 2.

(3) Production of Fixing Belt

A fixing belt was obtained in the same manner as in Example 2 except that the surface of the elastic layer before the curing of the rubber was not charged with a corona charger.

(4) Evaluation of Elastic Layer (4-1) Evaluation of Uneven Distribution of Fillers by Average of Representative Coefficients A and B of Variation of Inter-Surface Distance Between Fillers The representative coefficient A of variation of an inter-surface distance between the fillers in the thickness direction of the elastic layer of the fixing belt in each image was determined in the same manner as in Example 1, and the average of the determined values was calculated. As a result, the average was 1.20. In addition, the representative coefficient B of variation of an inter-surface distance between the fillers in the direction (MD) perpendicular to the peripheral direction of the fixing member in each image was determined, and the average of the determined values was calculated. As a result, the average was 1.16.

(4-2) Circle-Equivalent Diameters and Area Proportions of Fillers

The circle-equivalent diameters of the respective fillers were calculated in the same manner as in Example 1. As a result, the average of the circle-equivalent diameters of magnesium oxide serving as the first filler was 1 μm, and the maximum thereof was less than 4 μm. In addition, the average of the circle-equivalent diameters of metal silicon serving as the second filler was 15 μm, and circle-equivalent diameters of 5 μm or more accounted for 96% or more thereof.

In addition, the area proportions of the fillers were determined in the same manner as in Example 1. As a result, the area proportions of the first filler and the second filler were 10% and 33%, respectively. Accordingly, the content of the first filler with respect to the elastic layer was 10 vol %, and the content of the second filler with respect thereto was 33 vol %, and the content of the fillers (first filler+second filler) with respect to the elastic layer was 43 vol %.

(4-3) Thermal Conductivity of Elastic Layer of Fixing Belt in Thickness Direction The thermal conductivity λ of the elastic layer in the thickness direction was calculated in the same manner as in Example 1. As a result, the thermal conductivity was 1.1 W/(m·K).

Comparative Example 3

(1) Chamfering Treatment and Classification of Metal Silicon Filler

Chamfering treatment and classification were performed in the same manner as in Example 3.

(2) Preparation of Liquid Addition-Curable Silicone Rubber Mixture

A liquid addition-curable silicone rubber mixture was obtained in the same manner as in Example 3.

(3) Production of Fixing Belt

A fixing belt was obtained in the same manner as in Example 3 except that the surface of the elastic layer before the curing of the rubber was not charged with a corona charger.

(4) Evaluation of Elastic Layer of Fixing Belt (4-1) Evaluation of Uneven Distribution of Fillers by Average of Representative Coefficients of Variation of Inter-Surface Distance Between Fillers The representative coefficient A of variation of an inter-surface distance between the fillers in the thickness direction of the elastic layer of the fixing belt in each image was determined in the same manner as in Example 1, and the average of the determined values was calculated. As a result, the average was 1.37. In addition, the representative coefficient B of variation of an inter-surface distance between the fillers in the direction (MD) perpendicular to the peripheral direction of the fixing member in each image was determined, and the average of the determined values was calculated. As a result, the average was 1.28.

(4-2) Circle-Equivalent Diameters and Area Proportions of Fillers

The circle-equivalent diameters of the respective fillers were calculated in the same manner as in Example 1. As a result, the average of the circle-equivalent diameters of magnesium oxide serving as the first filler was 1 μm, and the maximum thereof was less than 4 μm. In addition, the average of the circle-equivalent diameters of metal silicon serving as the second filler was 14 μm, and circle-equivalent diameters of 5 μm or more accounted for 98% or more thereof.

In addition, the area proportions of the fillers were determined in the same manner as in Example 1. As a result, the area proportions of the first filler and the second filler were 12% and 31%, respectively. Accordingly, the content of the first filler with respect to the elastic layer was 12 vol %, and the content of the second filler with respect thereto was 31 vol %, and the content of the fillers (first filler+second filler) with respect to the elastic layer was 43 vol %.

(4-3) Thermal Conductivity of Elastic Layer of Fixing Belt in Thickness Direction The thermal conductivity λ of the elastic layer in the thickness direction was calculated in the same manner as in Example 1. As a result, the thermal conductivity was 1.0 W/(m·K).

Comparative Example 4

(1) Chamfering Treatment and Classification of Metal Silicon Filler

Chamfering treatment and classification were performed in the same manner as in Example 3.

(2) Preparation of Liquid Addition-Curable Silicone Rubber Mixture

A liquid addition-curable silicone rubber mixture was obtained in the same manner as in Example 4.

(3) Production of Fixing Belt

A fixing belt was obtained in the same manner as in Example 4 except that the surface of the elastic layer before the curing of the rubber was not charged with a corona charger.

(4) Evaluation of Elastic Layer of Fixing Belt (4-1) Evaluation of Uneven Distribution of Fillers by Average of Representative Coefficients A and B of Variation of Inter-Surface Distance Between Fillers The representative coefficient A of variation of an inter-surface distance between the fillers in the thickness direction of the elastic layer of the fixing belt in each image was determined in the same manner as in Example 1, and the average of the determined values was calculated. As a result, the average was 1.19. In addition, the representative coefficient B of variation of an inter-surface distance between the fillers in the direction (MD) perpendicular to the peripheral direction of the fixing member in each image was determined, and the average of the determined values was calculated. As a result, the average was 1.15.

(4-2) Circle-Equivalent Diameters and Area Proportions of Fillers

The circle-equivalent diameters of the respective fillers were calculated in the same manner as in Example 1. As a result, the average of the circle-equivalent diameters of magnesium oxide serving as the first filler was 1 μm, and the maximum thereof was less than 4 km. In addition, the average of the circle-equivalent diameters of metal silicon serving as the second filler was 14 μm, and circle-equivalent diameters of 5 μm or more accounted for 98% or more thereof.

In addition, the area proportions of the fillers were determined in the same manner as in Example 1. As a result, the area proportions of the first filler and the second filler were 8% and 35%, respectively. Accordingly, the content of the first filler with respect to the elastic layer was 8 vol %, and the content of the second filler with respect thereto was 35 vol %, and the content of the fillers (first filler+second filler) with respect to the elastic layer was 43 vol %.

(4-3) Thermal Conductivity of Elastic Layer of Fixing Belt in Thickness Direction The thermal conductivity λ of the elastic layer in the thickness direction was calculated in the same manner as in Example 1. As a result, the thermal conductivity was 1.0 W/(m·K).

TABLE 1

| | First filler | | | Second filler | | | | Content of | | Average of representative coefficients of variation | | Volume proportion | Thermal |
|---|---|---|---|---|---|---|---|---|---|---|---|---|---|
| | Kind | Circle-equivalent diameter | Content with respect to elastic layer (vol %) | Kind | Circle-equivalent diameter | Content with respect to elastic layer (vol %) | Repose angle (°) | filler with respect to elastic layer (vol %) | Electric field application | A (Thickness direction of elastic layer) | B (MD) | of second filler/volume proportion of first filler | conductivity in thickness direction (W/(m · K)) |
| Example 1 | MgO | Average: 1 μm Maximum: less than 4 μm (on volume basis) | 10 | Si subjected to chamfering treatment | Average: 18 μm Circle-equivalent diameters of 5 μm or more account for 98% or more of all circle-equivalent diameters (on volume basis) | 33 | 42 | 43 | Present | 1.79 | 1.53 | 3.30 | 1.9 |
| Example 2 | | | 10 | Si | Average: 15 μm Circle-equivalent diameters of 5 μm or more account for 96% or more of all circle-equivalent diameters (on volume basis) | 33 | 57 | | | 1.43 | 1.23 | 3.30 | 1.7 |
| Example 3 | | | 12 | Si subjected to chamfering treatment under air | Average: 14 μm Circle-equivalent diameters of 5 μm or more account for 98% or more of all circle-equivalent diameters (on volume basis) | 31 | 41 | | | 1.94 | 1.45 | 2.58 | 1.8 |
| Example 4 | | | 8 | | | 35 | | | | 1.83 | 1.45 | 4.38 | 1.6 |
| Comparative Example 1 | | | 10 | Si subjected to chamfering treatment | Average: 18 μm Circle-equivalent diameters of 5 μm or more account for 98% or more of all circle-equivalent diameters (on volume basis) | 33 | 42 | | Absent | 1.32 | 1.33 | 3.30 | 1.1 |

TABLE 1-continued

| | First filler | | | Second filler | | | | Content of | | Average of representative coefficients of variation | | Volume proportion | Thermal |
|---|---|---|---|---|---|---|---|---|---|---|---|---|---|
| | Kind | Circle-equivalent diameter | Content with respect to elastic layer (vol %) | Kind | Circle-equivalent diameter | Content with respect to elastic layer (vol %) | Repose angle (°) | filler with respect to elastic layer (vol %) | Electric field application | A (Thickness direction of elastic layer) | B (MD) | of second filler/volume proportion of first filler | conductivity in thickness direction (W/(m · K)) |
| Comparative Example 2 | | | 10 | Si | Average: 15 μm Circle-equivalent diameters of 5 μm or more account for 96% or more of all circle-equivalent diameters (on volume basis) | 33 | 57 | | | 1.20 | 1.16 | 3.30 | 1.1 |
| Comparative Example 3 | | | 12 | Si subjected to chamfering treatment under air | Average: 14 μm Circle-equivalent diameters of 5 μm or more account for 98% or more of all circle-equivalent diameters (on volume basis) | 31 | 41 | | | 1.37 | 1.28 | 2.58 | 1.0 |
| Comparative Example 4 | | | 8 | | | 35 | | | | 1.19 | 1.15 | 4.38 | 1.0 |

[Evaluation Result]

The evaluation results of Examples and Comparative Examples shown in Table 1 are described below.

Each of the elastic layers of Examples 1 to 4 contains the silicone rubber and the fillers dispersed in the silicone rubber, and the content of the fillers with respect to the elastic layer is 43 vol %. In addition, the fillers include magnesium oxide serving as the first filler and metal silicon serving as the second filler, and the proportion of the sum of the first filler and the second filler to the total amount of the fillers is 100%. Further, the average of 6 sets of the representative coefficient A of variation of the inter-surface distance between the fillers in the thickness direction of the elastic layer is 1.4 or more, and hence it is found that the fillers are unevenly distributed in the thickness direction.

In addition, in each of Examples 1, 3, and 4, the second filler was subjected to the chamfering treatment, and hence has a repose angle smaller than that of Example 2 in which no chamfering was performed. In other words, the shape of the filler is free of a corner that is a pointed portion. Thus, in each of Examples 1, 3, and 4, the average of 6 sets of the representative coefficient B of variation of the inter-surface distance between the fillers in the direction (MD) perpendicular to the peripheral direction of the fixing member is 1.4 or more, and hence it is found that the fillers are unevenly distributed not only in the thickness direction but also in the direction perpendicular to the peripheral direction.

In each of Examples 1 to 4, the fillers are unevenly distributed to form heat conductive paths, and hence the thermal conductivity in the thickness direction is 1.6 W/(m·K) or more. Thus, it is found that the fixing belts are each excellent in heat-supplying ability.

In each of Comparative Examples 1 to 4, the average of 6 sets of the representative coefficients A and B of variation of the inter-surface distance between the fillers in each of the thickness direction and the direction perpendicular to the peripheral direction is less than 1.4, and hence it is found that the fillers are not unevenly distributed. As a result, the thermal conductivity in the thickness direction became less than 1.6 W/(m·K).

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-211426, filed Dec. 24, 2021, and Japanese Patent Application No. 2022-197895, filed Dec. 12, 2022 which are hereby incorporated by reference herein in their entirety.

What is claimed is:

1. A fixing member comprising:

a substrate having an endless shape; and an elastic layer on an outer peripheral surface of the substrate, the elastic layer containing a silicone rubber and fillers dispersed in the silicone rubber, a content of the fillers with respect to the elastic layer being 35 vol % to 50 vol %, the fillers including at least a first filler and a second filler, the first filler being at least one selected from the group consisting of magnesium oxide and zinc oxide, the second filler being at least one selected from the group consisting of metal silicon and silicon carbide, and a proportion of a sum of the first filler and the second filler to a total amount of the fillers in the elastic layer being 90 vol % or more, wherein when obtaining SEM images each having 115.2 μm long by 153.6 μm wide at 6 arbitrary sites of a cross-section of the elastic layer in a longitudinal direction perpendicular to a peripheral direction of the fixing member at a magnification of 2,000 times, provided that a vertical direction of each of the SEM images coincides with a thickness direction of the elastic layer, and a horizontal direction of each of the SEM images coincides with a longitudinal direction perpendicular to the thickness direction of the elastic layer, binarizing each of the SEM images so that portions of the fillers are black and a portion of the silicone rubber is white to obtain binarized images, and partitioning each of the binarized images into 1,024 columns in a horizontal direction thereof and 768 rows in a vertical direction thereof with a square pixel 0.15 μm on a side, as to each of the binarized images that have been partitioned, determining a coefficient of variation of inter-surface distances between the fillers in each pixel column, which has 768 rows, from a standard deviation and an average of the inter-surface distances between the fillers in the pixel column to obtain 1,024 coefficients of variation, and obtaining 6 sets of a representative coefficient A of variation for each of the binarized images, where the representative coefficient A of variation is an average of 50 largest numerical values out of the resultant 1,024 coefficients of variation, an arithmetic average of 6 sets of the representative coefficient A of variation, is 1.4 or more.

2. The fixing member according to claim 1, wherein as to each of the binarized images that have been partitioned, determining a coefficient of variation between the fillers in each pixel row, which has 1,024 columns, from a standard deviation and an average of the inter-surface distances between the fillers in the pixel row to obtain 768 coefficients of variation, and obtaining 6 sets of a representative coefficient B of variation for each of the binarized images, where the representative coefficient B of variation is an average of 40 largest numerical values out of resultant 768 coefficients of variation, an arithmetic average of 6 sets of the representative coefficient B of variation, is 1.4 or more.

3. The fixing member according to claim 1, wherein the first filler has a circle-equivalent diameter of 5 μm or less, and the second filler has a circle-equivalent diameter of 5 μm or more.

4. The fixing member according to claim 1, wherein the second filler has a repose angle of 35° to 52° or less.

5. The fixing member according to claim 1, wherein a ratio of a volume proportion of the second filler in the elastic layer to a volume proportion of the first filler, in the elastic layer is 2.0 to 7.0.

6. The fixing member according to claim 1, wherein the elastic layer has a thermal conductivity in a thickness direction of 1.6 W/(m·K) or more.

7. The fixing member according to claim 1, further comprising a surface layer on an outer periphery of the elastic layer.

8. The fixing member according to claim 1, wherein the substrate contains at least one selected from the group consisting of nickel, copper, iron, and aluminum.

9. A heat fixing device comprising:

a fixing member for heating; and a pressurizing member arranged to face the fixing member, wherein the fixing member includes a substrate having an endless shape and an elastic layer formed on an outer peripheral surface of the substrate, the elastic layer contains a silicone rubber and fillers dispersed in the silicone rubber, a content of the fillers with respect to the elastic layer is 35 vol % to 50 vol %, the fillers includes at least a first filler and a second filler, the first filler is at least one selected from the group consisting of magnesium oxide and zinc oxide, the second filler is at least one selected from the group consisting of metal silicon and silicon carbide, and a proportion of a sum of the first filler and the second filler to a total amount of the fillers in the elastic layer is 90 vol % or more, and wherein when:

obtaining SEM images each having 115.2 μm long by 153.6 μm wide at 6 arbitrary sites of a cross-section of the elastic layer in a longitudinal direction perpendicular to a peripheral direction of the fixing member at a magnification of 2,000 times, provided that a vertical direction of each of the SEM images coincides with a thickness direction of the elastic layer, and a horizontal direction of each of the SEM images coincides with a longitudinal direction perpendicular to the thickness direction of the elastic layer, binarizing each of the SEM images so that portions of the fillers are black and a portion of the silicone rubber is white to obtain binarized images, and partitioning each of the binarized images into 1,024 columns in a horizontal direction thereof and 768 rows in a vertical direction thereof with a square pixel 0.15 μm on a side, as to each of the binarized images that have been partitioned, determining a coefficient of variation of inter-surface distances between the fillers in each pixel column, which has 768 rows, from a standard deviation and an average of the inter-surface distances between the fillers in the pixel column to obtain 1,024 coefficients of variation, and obtaining 6 sets of a representative coefficient A of variation for each of the binarized images, where the representative coefficient A is an average of 50 largest numerical values out of the resultant 1,024 coefficients of variation, an arithmetic average of 6 sets of the representative coefficient A of variation, is 1.4 or more.

10. The heat fixing device according to claim 9, further comprising a heating unit configured to heat the substrate of the fixing member.

11. The heat fixing device according to claim 10, wherein the heating unit is an induction heating unit, and the substrate of the fixing member is a substrate heatable by induction heating.

12. The heat fixing device according to claim 10, wherein the heating unit is a heater configured to heat the substrate.

13. The heat fixing device according to claim 12, wherein the heater is arranged in contact with an inner peripheral surface of the fixing member.

* * * * *